US010771913B2

(12) United States Patent
Warner

(10) Patent No.: US 10,771,913 B2
(45) Date of Patent: Sep. 8, 2020

(54) DETERMINING SOUND LOCATIONS IN MULTI-CHANNEL AUDIO

(71) Applicant: DTS, Inc., Calabasas, CA (US)

(72) Inventor: Aaron Warner, Seattle, WA (US)

(73) Assignee: DTS, Inc., Calabasas, CA (US)

( * ) Notice: Subject to any disclaimer, the term of this patent is extended or adjusted under 35 U.S.C. 154(b) by 0 days.

(21) Appl. No.: 16/408,837

(22) Filed: May 10, 2019

(65) Prior Publication Data

US 2019/0349704 A1 Nov. 14, 2019

Related U.S. Application Data

(60) Provisional application No. 62/670,598, filed on May 11, 2018.

(51) Int. Cl.

| | |
|---|---|
| ***H04S 7/00*** | (2006.01) |
| ***G10L 19/008*** | (2013.01) |
| ***H04S 3/00*** | (2006.01) |

(52) U.S. Cl.

CPC ..... *H04S 7/305* (2013.01); *G10L 19/008* (2013.01); *H04S 3/006* (2013.01); *H04S 2400/01* (2013.01)

(58) Field of Classification Search

CPC ..... H04S 7/305; H04S 3/006; H04S 2400/01; G10L 19/008

See application file for complete search history.

(56) References Cited

U.S. PATENT DOCUMENTS

| | | | |
|---|---|---|---|
| 5,892,834 | A | 4/1999 | Smart et al. |
| 7,333,622 | B2 | 2/2008 | Algazi et al. |
| 9,584,946 | B1 | 2/2017 | Lyren et al. |
| 9,699,583 | B1 | 7/2017 | Lyren et al. |
| 9,800,990 | B1 | 10/2017 | Lyren et al. |

(Continued)

FOREIGN PATENT DOCUMENTS

| | | | |
|---|---|---|---|
| WO | WO-2019217808 | A1 | 11/2019 |

OTHER PUBLICATIONS

Alan Lofft, Going to 7.1-Channel Surround Sound, Audioholics Online A/V Magazine, https://web.archive.org/web/20131009034645/https://www.audioholics.com/audio-technologies/7-1-surround-sound (Year: 2013).*

(Continued)

*Primary Examiner* — Walter F Briney, III

(74) *Attorney, Agent, or Firm* — Schwegman Lundberg & Woessner, P.A.

(57) ABSTRACT

A system and method can determine a time-varying position of a sound in a multi-channel audio signal. At least one processor can: receive a multi-channel audio signal representing a sound, each channel of the multi-channel audio signal providing audio associated with a corresponding channel position around a perimeter of a soundstage; determine a time-varying volume level for each channel of the multi-channel audio signal; determine, from the time-varying volume levels and the channel positions, a time-varying position in the soundstage of the sound; and generate a location data signal representing the time-varying position of the sound. The channel positions can be time-invariant. The position magnitude can be scaled to provide a unit magnitude as a sound pans from a channel to an adjacent channel. The position azimuth angle can be scaled to account for center location bias.

19 Claims, 15 Drawing Sheets

(56) References Cited

U.S. PATENT DOCUMENTS

| | | | | |
|---|---|---|---|---|
| 9,980,072 | B2 | 5/2018 | Lyren et al. | |
| 9,998,847 | B2 | 6/2018 | Norris et al. | |
| 2006/0045275 | A1 | 3/2006 | Daniel | |
| 2009/0182564 | A1* | 7/2009 | Beack | H04S 3/008 704/500 |
| 2009/0252356 | A1* | 10/2009 | Goodwin | G10L 19/173 381/310 |
| 2010/0166226 | A1 | 7/2010 | Kikkawa et al. | |
| 2012/0045065 | A1* | 2/2012 | Ishihara | H04S 5/005 381/17 |
| 2012/0288124 | A1 | 11/2012 | Fejzo et al. | |
| 2014/0133661 | A1 | 5/2014 | Harma et al. | |
| 2017/0245081 | A1 | 8/2017 | Lyren et al. | |
| 2017/0295278 | A1 | 10/2017 | Lyren et al. | |
| 2017/0359666 | A1 | 12/2017 | Lyren et al. | |
| 2017/0359672 | A1 | 12/2017 | Lyren et al. | |
| 2018/0014138 | A1 | 1/2018 | Hess et al. | |
| 2018/0139565 | A1 | 5/2018 | Norris et al. | |

OTHER PUBLICATIONS

"International Application Serial No. PCT/US2019/031709, International Search Report dated Sep. 4, 2019", 2 pgs.
"International Application Serial No. PCT/US2019/031709, Written Opinion dated Sep. 4, 2019", 8 pgs.

* cited by examiner

DETERMINING SOUND LOCATIONS IN MULTI-CHANNEL AUDIO

CROSS-REFERENCE TO RELATED APPLICATION

This application claims the benefit of U.S. Provisional Application No. 62/670,598, filed May 11, 2018, which is hereby incorporated by reference in its entirety.

FIELD OF THE DISCLOSURE

The technology described in this document relates generally to identifying when sounds occur in multi-channel audio, and/or identifying where sounds are located in the soundstage of the multi-channel audio.

BACKGROUND OF THE DISCLOSURE

Users interacting in a real, and/or simulated environment can require or prefer assistance identifying when meaningful sounds occur, and/or where sounds in the environment are coming from, relative to the user.

For example, when a user is within a surround audio environment, localizing sound can be difficult due to limitations of spatial audio reproduction. As another example, when a user is wearing headphones, intensity panning, down-mix methods, binaural virtualization, and ambisonic renderings can be insufficient for accurately localizing sound due to limitations such as a front/back cone of confusion. As another example, localizing sound can be difficult even in real environments, due to factors such as hearing loss, high noise levels, reflections, and activity levels.

As a result, there exists a need for identifying when meaningful sounds occur in multi-channel audio, and/or identifying where such sounds are located in the soundstage of the multi-channel audio.

BRIEF DESCRIPTION OF THE DRAWINGS

Corresponding reference characters indicate corresponding parts throughout the several views. Elements in the drawings are not necessarily drawn to scale. The configurations shown in the drawings are merely examples, and should not be construed as limiting the scope in any manner.

DETAILED DESCRIPTION

A system for processing multi-channel audio can include at least one processor. The at least one processor can: receive a multi-channel audio signal representing a sound, each channel of the multi-channel audio signal configured to provide audio associated with a corresponding time-invariant channel position around a perimeter of a soundstage; determine a time-varying volume level for each channel of the multi-channel audio signal; determine, from the time-varying volume levels and the time-invariant channel positions, a time-varying position in the soundstage of the sound; and generate a location data signal representing the time-varying position of the sound. These aspects, and more, of the system and of suitable methods, are discussed in detail below.

Figure 1:
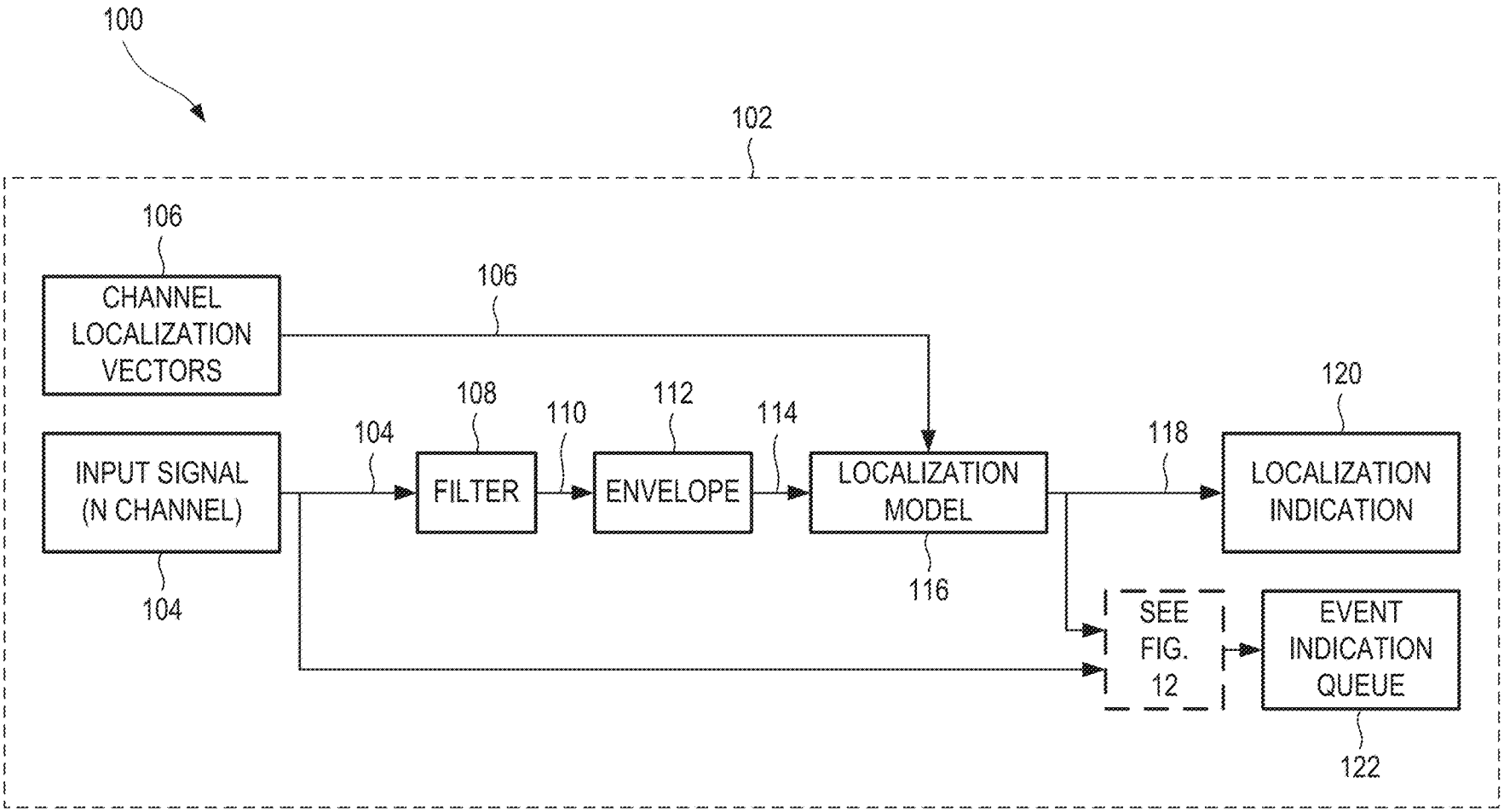
FIG. 1 shows an example of a system for processing multi-channel audio, in accordance with some embodiments.

FIG. 1 shows an example of a system 100 for processing multi-channel audio, in accordance with some embodiments. The system 100 can determine a time-varying position of a sound in a multi-channel audio signal. The configuration of FIG. 1 is but one example of a system that can determine a time-varying position of a sound in a multi-channel audio signal. Other suitable systems can also be used.

In FIG. 1, an input signal can drive two processing paths. In a first path, shown in the upper half of FIG. 1, the system 100 can localize the received audio through filtering, estimating the signal envelope, and employing a localization model. The localization model can calculate a directional vector, where an azimuthal angle of the vector (in two dimensions; and a more generalized angle or set of angles for three dimensions) represents the direction of sound origin, and the magnitude represents the discreteness of the panning to the angle. In a second path, shown in the lower half of FIG. 1, the system 100 can identify events within the signal for which the user should be notified. Event notifications can include a variety of data about the event such as, but not limited to, the events calculated, localization vector, energy, movement, and time. An event queue can prioritize events based on user preferences and event data that can be indicated to the user. Event detection is discussed below with regard to FIG. 12.

The system 100 can include at least one processor 102. In some examples, all of the tasks discussed below are performed by a single processor. In other examples, at least two of the tasks discussed below are performed by different processors. The different processors can include different processing circuits on a same chip, processors on different circuit boards that operate within a same computing device, or processors in different device that communicate with each other via a wired or wireless network. For simplicity, the discussion below refers to a single processor 102, with the understanding that each instance of the term "processor" can be replaced by the phrase "at least one processor", as explained above.

The processor 102 can receive a multi-channel audio signal 104 representing a sound. For example, the multi-channel audio signal 104 can include the audio for a video game. As the game progresses, events can occur during play, such as a gun firing, or a horn honking. It is a goal of the processing discussed below to analyze the multi-channel audio signal 104, to extract locations in an audio soundstage of the gun firing, or the horn honking, from just the multi-channel audio signal 104. The extracted location can be used in a downstream application, such as displaying a graphic element on a display at a position that corresponds to the extracted location of the sound.

Each channel of the multi-channel audio signal 104 can provide audio associated with a corresponding time-invariant channel position around a perimeter of a soundstage. For example, the multi-channel audio signal 104 can correspond to a standardized placement of speakers around a listener. During operation, the audio in the multi-channel audio signal 104 can vary over time, but the channel positions remain time-invariant.

In some examples, the soundstage can be circular. In these examples, the time-invariant channel positions can be located at respective azimuthal positions around a circumference of the soundstage, with a center of the soundstage corresponding to a listener position. Some of these circular soundstage configurations can be used for home theater setups.

Figure 2:
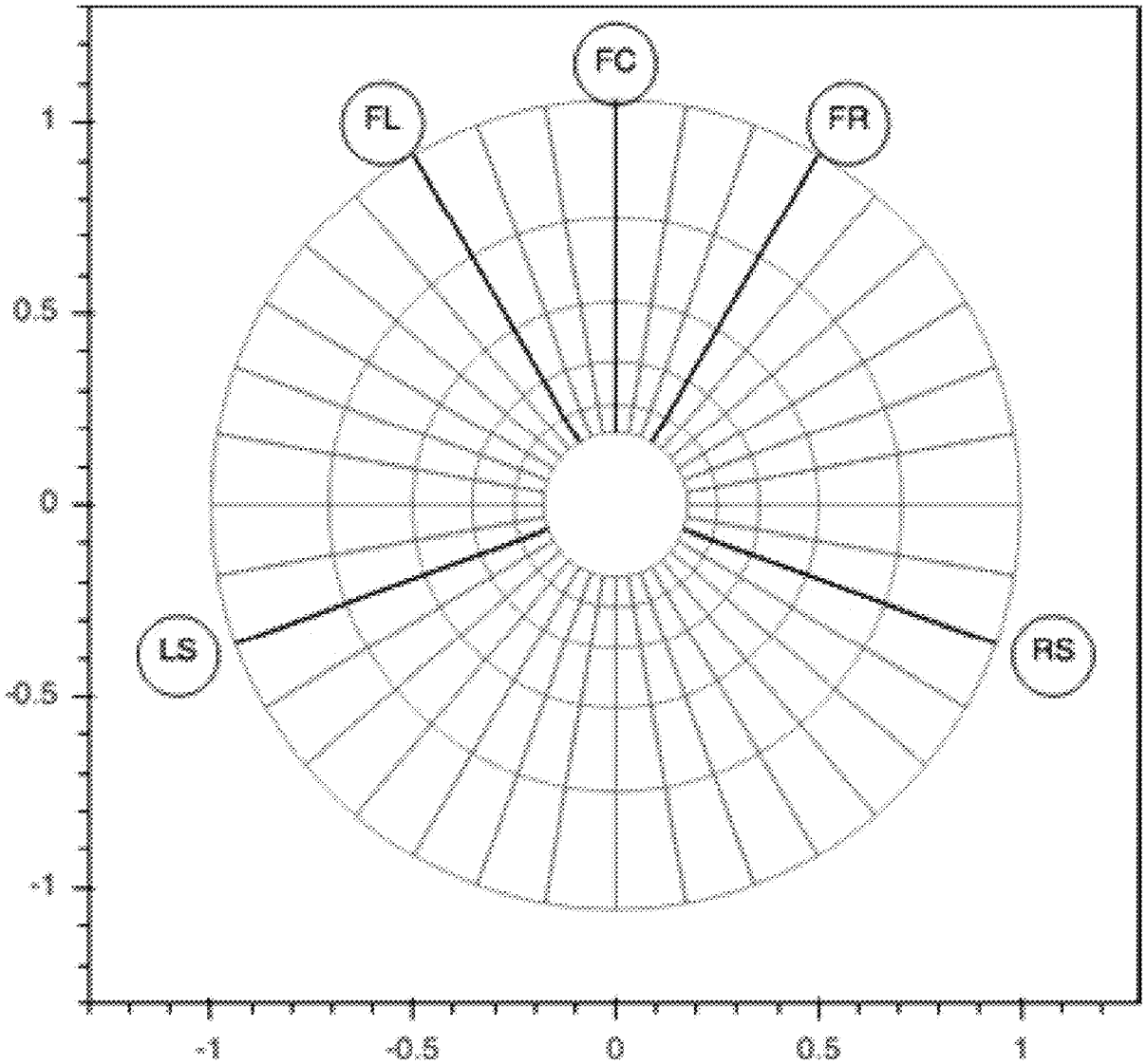
FIG. 2 shows a specific example of time-invariant channel positions corresponding to 5.1-channel audio, in accordance with some embodiments.

FIG. 2 shows a specific example of time-invariant channel positions corresponding to 5.1-channel audio, in accordance with some embodiments. The 5.1 channels can include a front center channel (FC) positioned azimuthally in front of the listener position. The 5.1 channels can include a front left channel (FL) and front right channel (FR) each azimuthally angled thirty degrees from the front center channel (FC). The 5.1 channels can include a left surround channel (LS) and a right surround channel (RS) each azimuthally angled one hundred ten degrees from the front center channel (FC). This is but one example of a configuration for time-invariant channel positions; other configurations can also be used.

Figure 3:
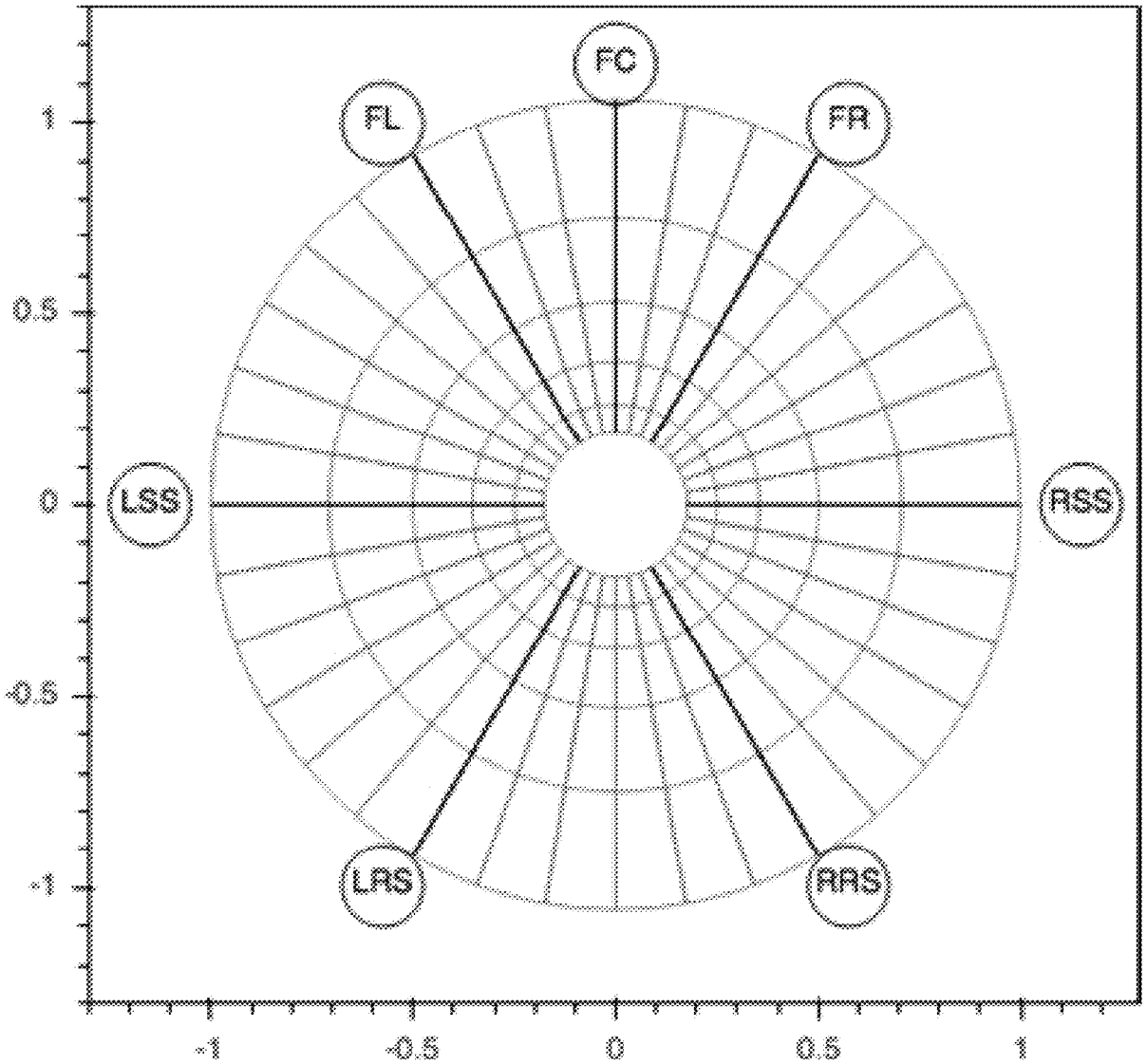
FIG. 3 shows a specific example of time-invariant channel positions corresponding to 7.1-channel audio, in accordance with some embodiments.

FIG. 3 shows a specific example of time-invariant channel positions corresponding to 7.1-channel audio, in accordance with some embodiments. The 7.1 channels can include a front center channel (FC) positioned azimuthally in front of the listener position. The 7.1 channels can include a front left channel (FL) and front right channel (FR) each azimuthally angled thirty degrees from the front center channel (FC). The 7.1 channels can include a left side surround channel (LSS) and a right side surround channel (RSS) each azimuthally angled ninety degrees from the front center channel (FC). The 7.1 channels can include a left rear surround channel (LRS) and a right rear surround channel (RRS) each azimuthally angled one hundred fifty degrees from the front center channel (FC). This is but one example of a configuration for time-invariant channel positions; other configurations can also be used.

Another specific example of time-invariant channel positions can correspond to a stereo multi-channel audio signal. In some examples, the stereo multi-channel audio signal can include a left channel and a right channel each azimuthally angled thirty degrees from a front of the listener position. This is but one example of a configuration for time-invariant channel positions; other configurations can also be used.

The examples of 5.1-channel, 7.1-channel, and stereo audio are all example of a circular soundstage, in which the time-invariant channel positions are all positioned at generally the same height, corresponding to a height of the ears of a listener. In other examples, the soundstage can be three-dimensional, to extend over and/or under the listener. For example, the soundstage can be spherical, where the time-invariant channel positions can be located at respective positions around the sphere, and a center of the sphere can correspond to a listener position. This is but one example of a configuration for time-invariant channel positions; other configurations can also be used.

For all of the configurations discussed above, the time-invariant channel positions can be stored on a server and/or retrieved from a server as channel localization vectors 106. Mathematically, for a specified channel format, each channel location, m, can be represented as a unit vector, $p_m$, with a zero degree angle representing the position directly in front of the user. In the conventions of FIGS. 2 and 3, negative angles can be located to the left of center, and positive angles can be located to the right of center. Other coordinate systems can alternatively be used. In some examples, surround formats having LFE channels, such as 5.1, and 7.1, can be reduced to non LFE formats, because LFE channels are not intended to have spatial queues.

Returning to FIG. 1, the processor 102 can, optionally, apply a high-pass filter 108 to each channel of the multi-channel audio signal 104, to form a filtered multi-channel audio signal 110. Because the signal energy of an arbitrary spatial environment commonly contains significant amounts of low-frequency energy relative to mid-range or high frequency energy, the high-pass filters 108 can de-emphasize non-directional low frequencies of the sound in determining the time-varying position of the sound. In some examples, the high-pass filter 108 can be a soft filter that rolls off low frequencies. In other examples, the high-pass filter 108 can be a relatively sharp filter that rolls off low frequencies below a cutoff frequency. In some examples, the high-pass filter 108 can roll off or attenuate frequencies below a cutoff frequency, such as 200 Hz. Other suitable cutoff frequencies can also be used.

The processor 102 can estimate a channel envelope 112 of the filtered multi-channel audio signal 110 to determine a time-varying volume level 114 for each channel of the multi-channel audio signal 104. As a specific example, the channel envelope 112 can include determining a time-varying root-mean-square (RMS) envelope for each channel, according to:

$$\hat{e}_m[n] = \sqrt{\frac{1}{k}\sum_{k=0}^{k-1} x_m[n-k]^2}$$

where $\hat{e}_m[n]$ is an estimated signal envelope of the filtered input signal $x_m$ (110) at time n. In other examples, the channel envelope 112 can include determining a time-varying peak envelope for each channel, determining a time-varying time-frequency transform magnitude for each channel, or others. In some examples, the processor 102 can estimate the channel envelopes 112 of one or more frames of audio. The frames can be overlapping or non-overlapping.

The processor 102 can apply a localization model 116 to determine a time-varying position 118 in the soundstage. Specifically, the localization model 116 can use the time-varying volume levels 114 and the time-invariant channel positions 106 as input. The localization model 116 can generate a time-varying position 118 as output, which represents a time-varying position of the sound in the soundstage. In some examples, the time-varying position 118 can be a time-varying vector that specifies a time-varying position in the soundstage. In examples in which the soundstage is circular (and flat), the time-varying position 118 can represent a two-dimensional position within the circular soundstage. Such a two-dimensional position can include a magnitude (e.g., a distance away from the center of the soundstage) and an azimuthal angle (e.g., an angular orientation within the soundstage, with respect to a front-facing direction). The two-dimensional position can be represented by a magnitude and an angle, or a pair of linear coordinates, or any suitable representation. Similarly, for examples in which the soundstage is spherical, the time-varying position 118 can be a time-varying vector that specifies a three-dimensional position in the soundstage. The processor can, at a localization indication 120, generate a location data signal representing the time-varying position of the sound. The multi-channel audio signal 104 and the time-varying position 118 can be used to form an event indication queue 122, as explained below with regard to FIG. 12. The localization model 116 is discussed in detail presently.

To estimate a position of a sound source, the processor 102 can use Gerzon vectors to provide an estimated position vector (or localization vector) as follows in Eq. (1):

$$\vec{d}[n] = \frac{\sum_{m=0}^{M-1} \hat{e}[m]\vec{p}[m]}{\sum_{m=0}^{M-1} \hat{e}[m]}, \tag{1}$$

In this estimate, quantity $\vec{d}[n]$ is a vector representing an estimated time-varying position (118), quantity M is a number of channels of audio, quantity n is a time index for samples of M channel volume envelopes, quantities $\hat{e}_m$ are channel envelope estimates (114), and quantities $\vec{p}[m]$ are channel localization vectors (106). In some examples, the estimated position vector $\vec{d}[n]$ can be normalized by a sum of the channel envelope estimates, as shown in the denominator of Eq. (1), so that both an angle and a magnitude of the estimated position vector $\vec{d}[n]$ can be independent of volume level.

Figure 4:
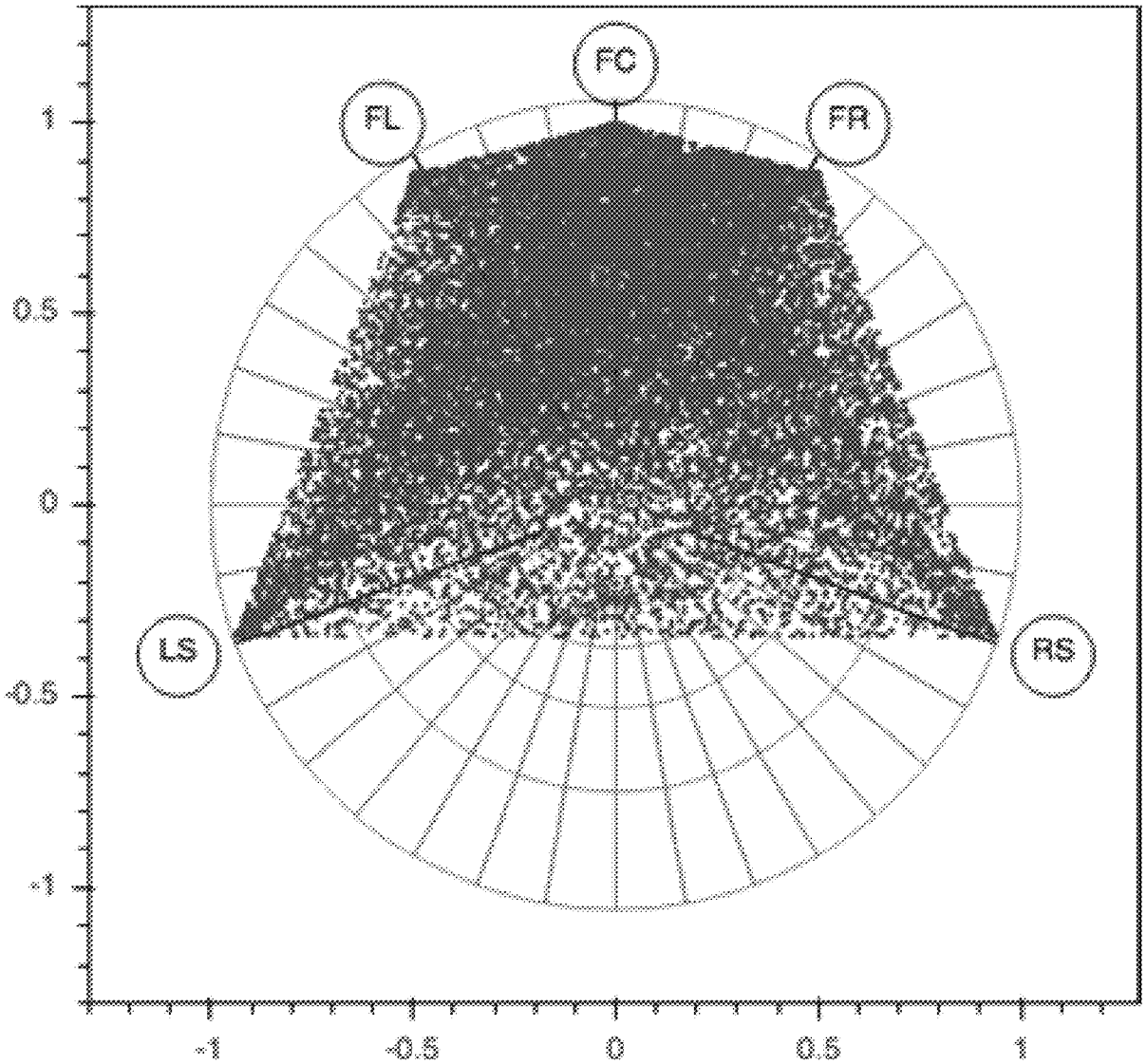
FIG. 4 shows a locus of all possible estimated position vectors within a circular soundstage, for a Gerzon vector formalism, in accordance with some embodiments.

FIG. 4 shows a locus of all possible estimated position vectors within a circular soundstage, for a Gerzon vector formalism shown above, in accordance with some embodiments.

For cases in which a sound is present in only one channel, the estimated position vector coincides with the channel in which the sound is present. These channels are positioned around a circumference of the soundstage (e.g., at a magnitude of unity), at specified angles.

For cases in which a sound is panned between only two channels, the estimated position vector lies on a line that connects the two channels.

For all pairs of adjacent channels, the connecting lines collectively define a polygonal shape in the soundstage. For all possible sounds produced by the channels, all the possible estimated position vectors fall on or within the polygonal shape shown as an outline of the locus of all possible estimated position vectors in FIG. 4. Because the example of FIG. 4 uses five channels, the polygon in FIG. 4 has five sides. Similarly, for an audio signal having seven channels, the comparable polygon would have seven sides. Other suitable configurations can also be used.

One drawback to using the estimated position vector as-is, as determined in Eq. (1) and shown in FIG. 4, is that significant portions of the soundstage can be inaccessible. For example, in FIG. 4, a significant portion of the rear of the soundstage (e.g., below a line connecting the left surround and right surround channel locations) remains inaccessible by the calculation shown in Eq. (1).

To overcome the drawback of using the estimated position vector as-is, and make all locations in the soundstage accessible, the processor 102 can scale a magnitude of the estimated position vector, such that estimated position vectors falling on an edge of the polygon shape are scaled to fall on the circumference of the soundstage, and estimated position vectors falling in an interior of the polygon shape are scaled to increase a magnitude of the estimated position vector. In some examples, the processor 102 can scale the magnitude of the estimated position vector by the inverse of the maximum magnitude possible (as defined by the polygon) for a given azimuthal angle.

Figure 5:
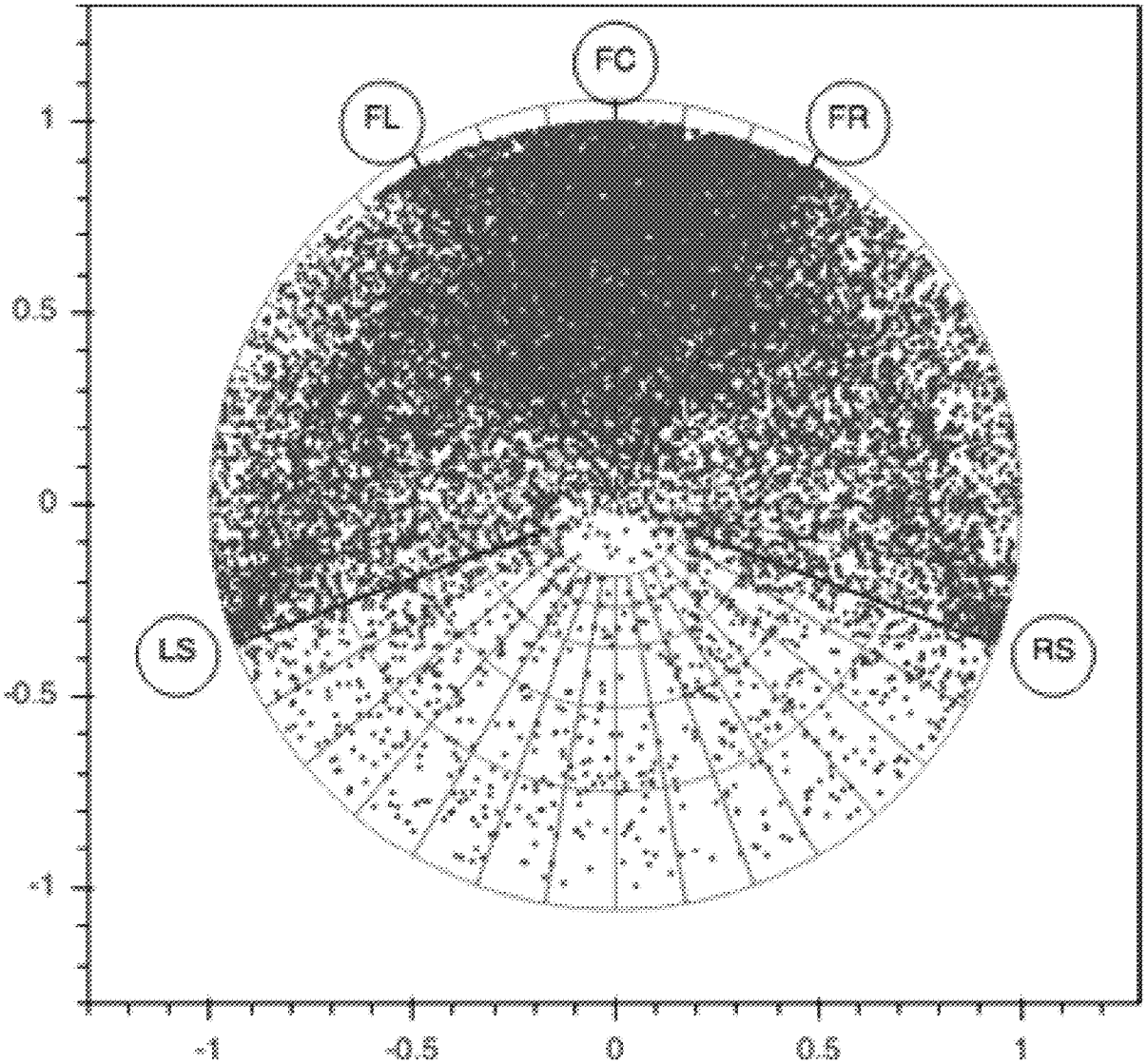
FIG. 5 shows a locus of all possible estimated position vectors within a circular soundstage, after scaling the magnitudes of the estimated position vectors, in accordance with some embodiments.

FIG. 5 shows a locus of all possible estimated position vectors within a circular soundstage, after scaling the magnitudes of the estimated position vectors, in accordance with some embodiments. Whereas before scaling, the estimated position vectors were confined to reside within a polygon, after scaling, the estimated position vectors can reside anywhere within the circular soundstage. Similar scaling can occur for three-dimensional soundstages, to allow the estimated position vectors to reside anywhere in the three-dimensional soundstage.

Before magnitude scaling, a sound panning sequentially around the soundstage, from channel to adjacent channel, will traverse the polygonal shape shown in FIG. 4. After magnitude scaling, a sound panning sequentially around the soundstage, from channel to adjacent channel, will traverse around a circumference of the soundstage, as shown in FIG. 5.

Another drawback to using the estimated position vector as-is, as determined in Eq. (1) and shown in FIG. 4, or with just the magnitude scaling shown in FIG. 5, is that the distributions of estimated positions can be biased toward a front of the soundstage. In the examples of FIGS. 4 and 5, because the front left, front center, and front right channels are positioned relatively close to a front/center position in the soundstage, and the left surround and right surround channels are positioned relatively far away from the rear/ center position in the soundstage, a random distribution of estimated position vectors shows a significant location bias toward the front of the soundstage.

Figure 6:
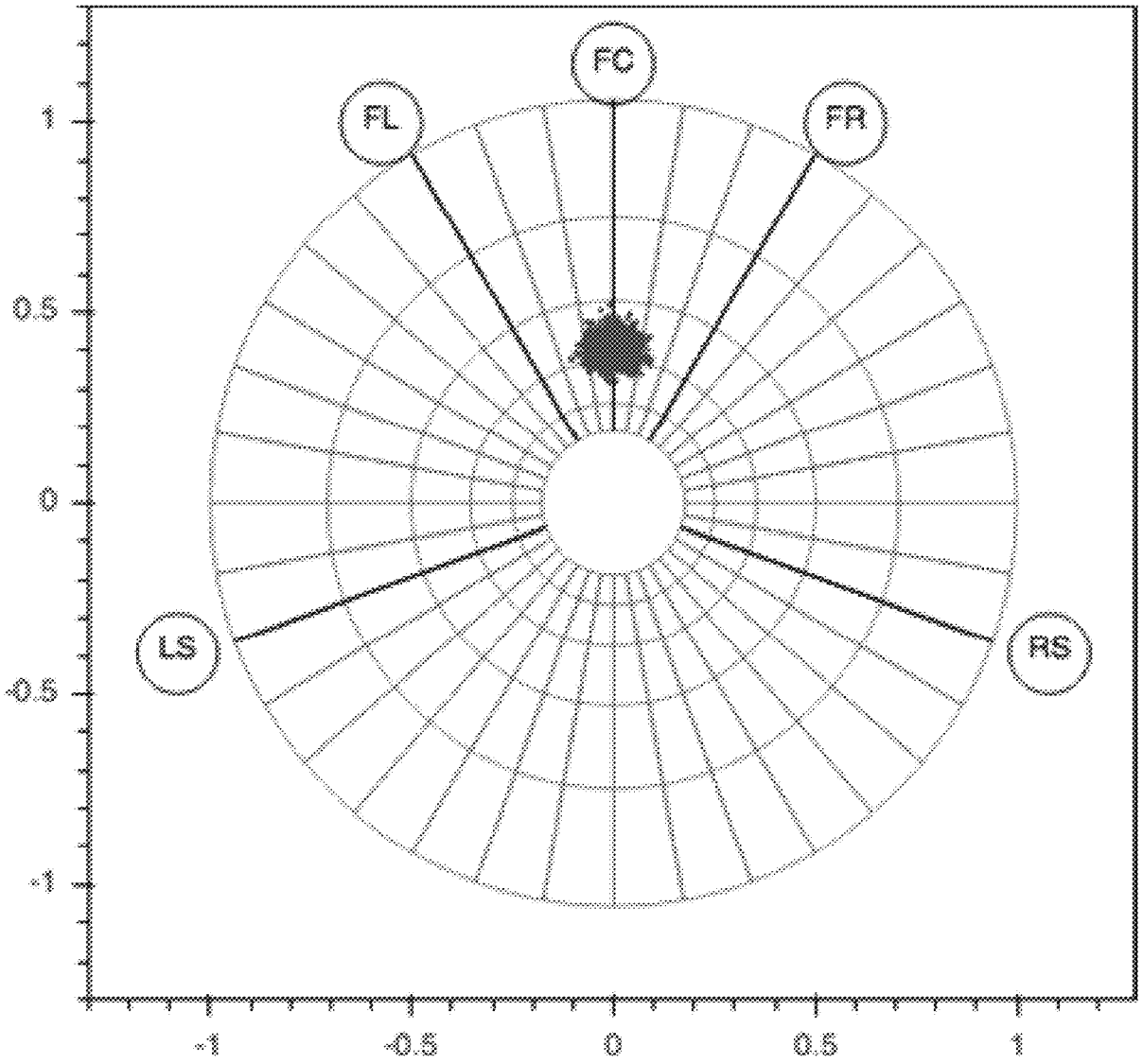
FIG. 6 shows an explicit example of the location bias present in FIGS. 4 and 5, in accordance with some embodiments.

FIG. 6 shows an explicit example of the location bias present in FIGS. 4 and 5, in accordance with some embodiments. FIG. 6 shows a locus of estimated position vectors, for a specific case of independent pink noise, with equal volumes in the channels. The estimated position vectors lie on a line connecting a center of the soundstage to the front center channel, and are significantly displaced from the center of the soundstage.

To overcome the drawback of location bias, which results from using the estimated position vector as-is, as determined in Eq. (1) and shown in FIG. 4, or with just the magnitude scaling shown in FIG. 5, the processor 102 can scale a azimuthal angle of the estimated position vector to adjust front-to-back symmetry, such that a test position vector corresponding to a case of independent pink noise having equal volume in all channels is scaled to fall substantially at the center of the soundstage.

The location bias can be corrected by calculating the estimated position vectors using symmetric versions of the channel layout, then interpolating the symmetric localization angles back to the input channel locations. Such a correction can be referred to as azimuthal angle scaling.

To accomplish this azimuthal angle scaling, the processor 102 can: determine provisional channel positions by equally spacing the time-invariant channel positions around the circumference of the soundstage; determining the estimated position vector using the provisional channel positions; and adjust an azimuthal angle of the estimated position vector to maintain a proportional relative spacing of the estimated position vector between a pair of adjacent channel positions, as the channel positions are adjusted from the provisional channel positions to the time-invariant channel positions.

Figure 7:
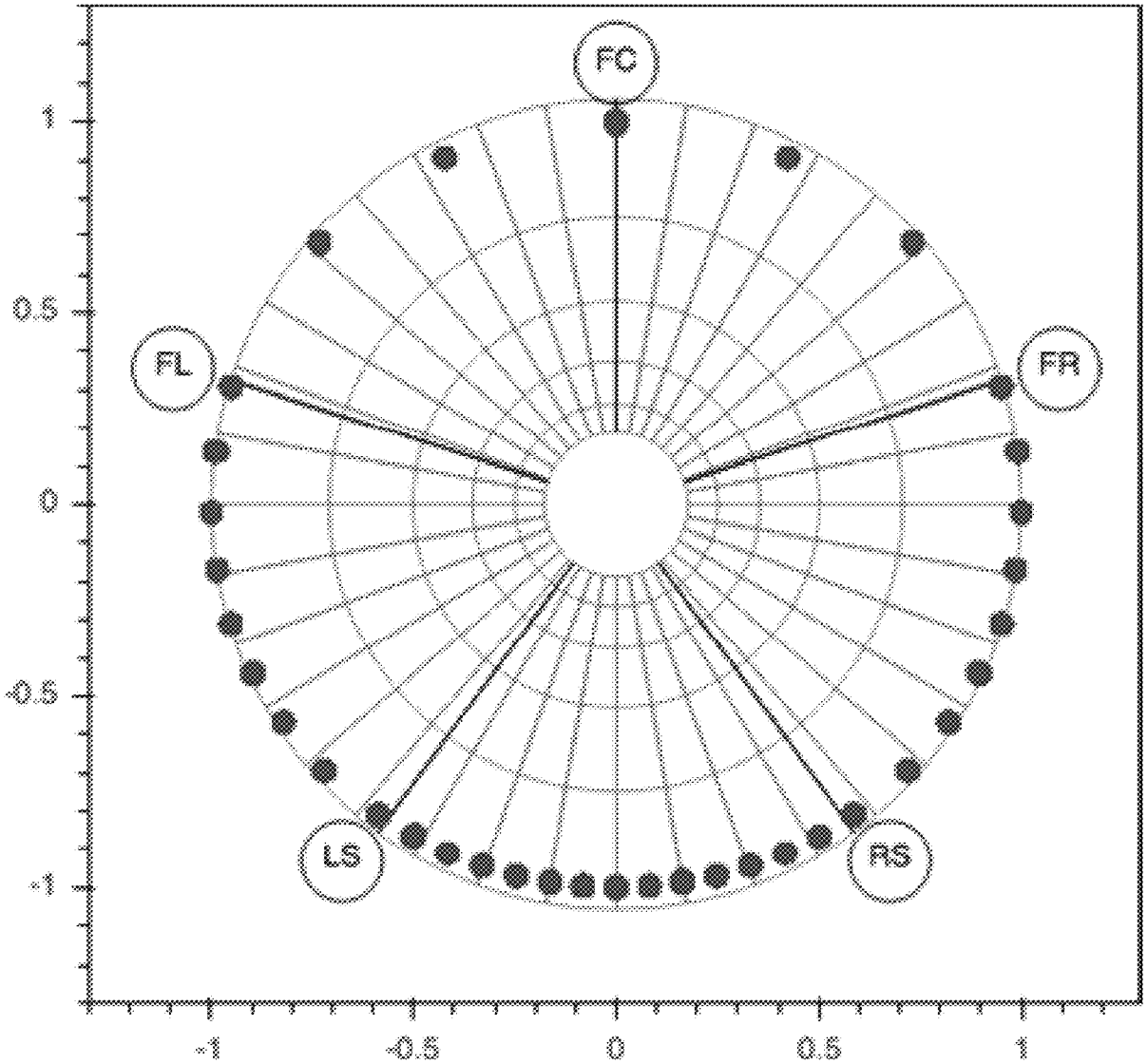
FIG. 7 shows an example of provisional time-invariant channel positions, which are provisionally equally spaced around the circumference of the soundstage, and a mono signal, panned in increments often degrees around the soundstage, in accordance with some embodiments.

FIG. 7 shows an example of provisional time-invariant channel positions, which are provisionally equally spaced around the circumference of the soundstage, and a mono signal, panned in increments often degrees around the soundstage, in accordance with some embodiments. The panned mono signal shows up as discrete dots around the circumference of the soundstage. The discrete dots are spaced relatively closely between the provisional locations of the left surround and right surround channels. The discrete dots are spaced relatively far apart between the provisional locations of the front left and front center channels, and between the provisional locations of the front center and front right channels.

Figure 8:
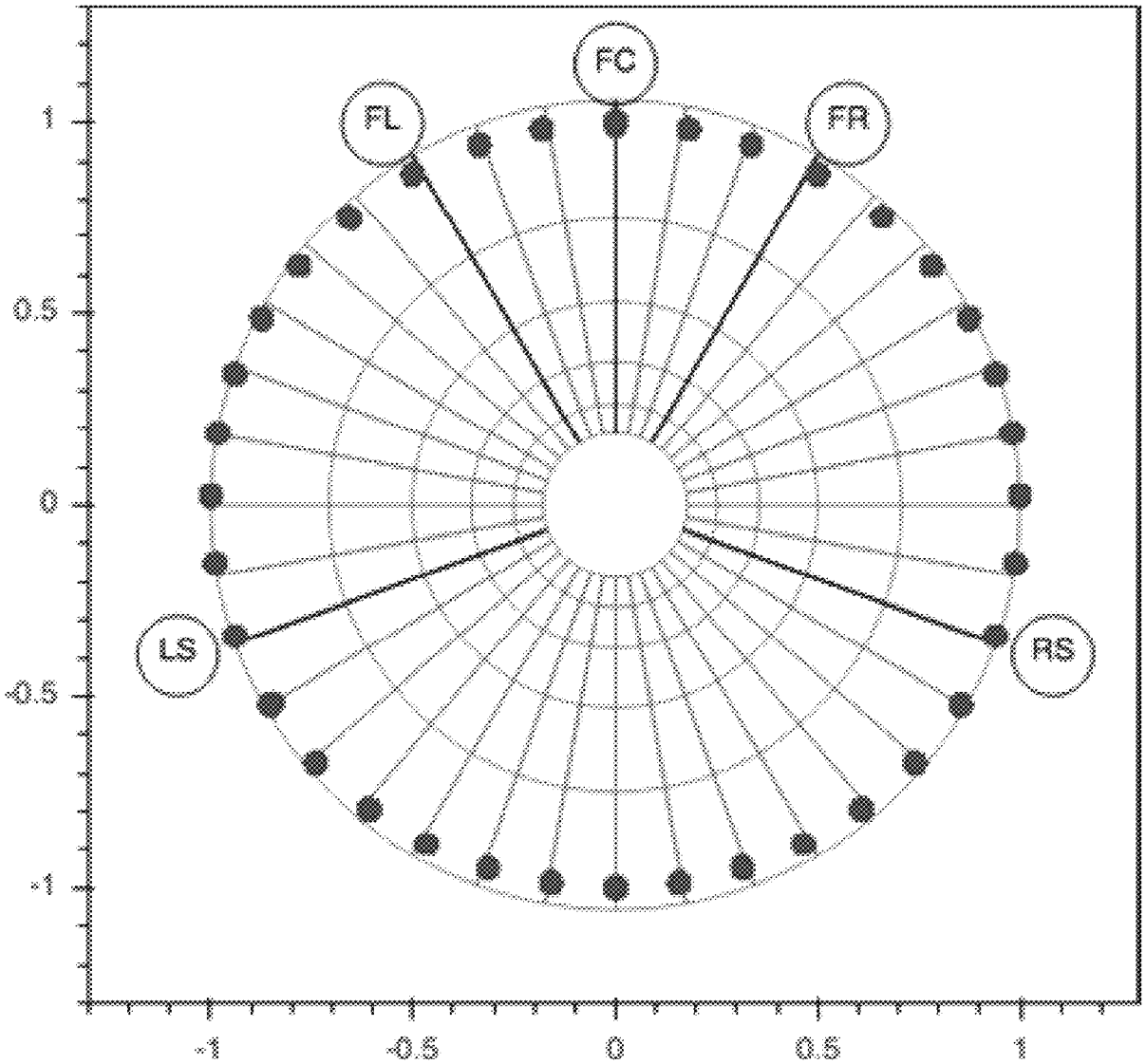
FIG. 8 shows an example of the time-invariant channel positions returned to their original positions from the provisional locations of FIG. 7, and a mono signal, panned in increments of ten degrees around the soundstage, in accordance with some embodiments.

FIG. 8 shows an example of the time-invariant channel positions returned to their original positions from the provisional locations of FIG. 7, and a mono signal, panned in increments often degrees around the soundstage, in accordance with some embodiments. The dot pattern in FIG. 8, after azimuthal angle scanning, is equally spaced around the circumference of the soundstage.

Figure 9:
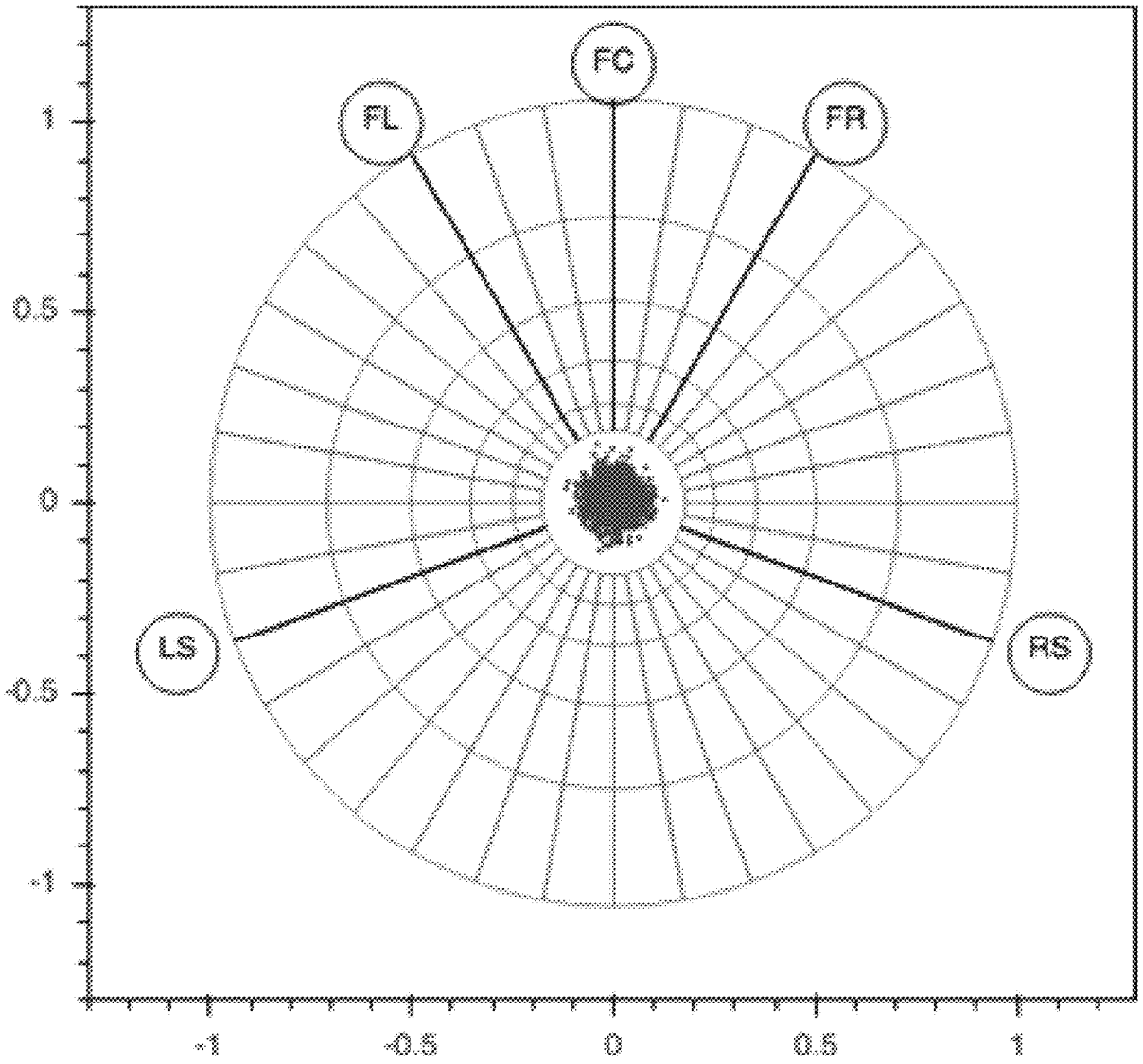
FIG. 9 shows a locus of estimated position vectors, for a specific case of independent pink noise, with equal volumes in the channels, after azimuthal angle scaling, in accordance with some embodiments.

FIG. 9 shows a locus of estimated position vectors, for a specific case of independent pink noise, with equal volumes in the channels, after azimuthal angle scaling, in accordance with some embodiments. The estimated position vectors all lie roughly at the center of the soundstage, showing a lack of location bias.

It is common for many producers of content or interactive audio engines to use the front center channel for certain types of sounds and not for others. For example, game audio frequently uses the front center channel for announcements and/or environmental sounds, but not for sounds that should be accurately localized as being peripherally panned between the front left and front right channels. Panning sounds between two nonadjacent channel locations can be referred to as phantom panning. Panning sound between the front left and front right channels without employing a center channel can be referred to as phantom center panning. As a result, there can be two ways in which a front center channel is treated: the multi-channel audio signal includes a front center channel that includes audio that is pannable, or the multi-channel audio signal includes a front center channel that is designated for audio that is not pannable.

For a front center channel that includes audio that is pannable, the processor 102 can determine the polygonal shape by linearly connecting each time-invariant channel position with its adjacent time-invariant channel positions, as explained above.

For a front center channel that is designated for audio that is not pannable, the processor 102 can determine the polygonal shape by linearly connecting each time-invariant channel position with its adjacent time-invariant channel positions except for the front center channel, such that the time-invariant channel positions directly adjacent to the front center channel linearly connect with the center of the soundstage.

Figure 10:
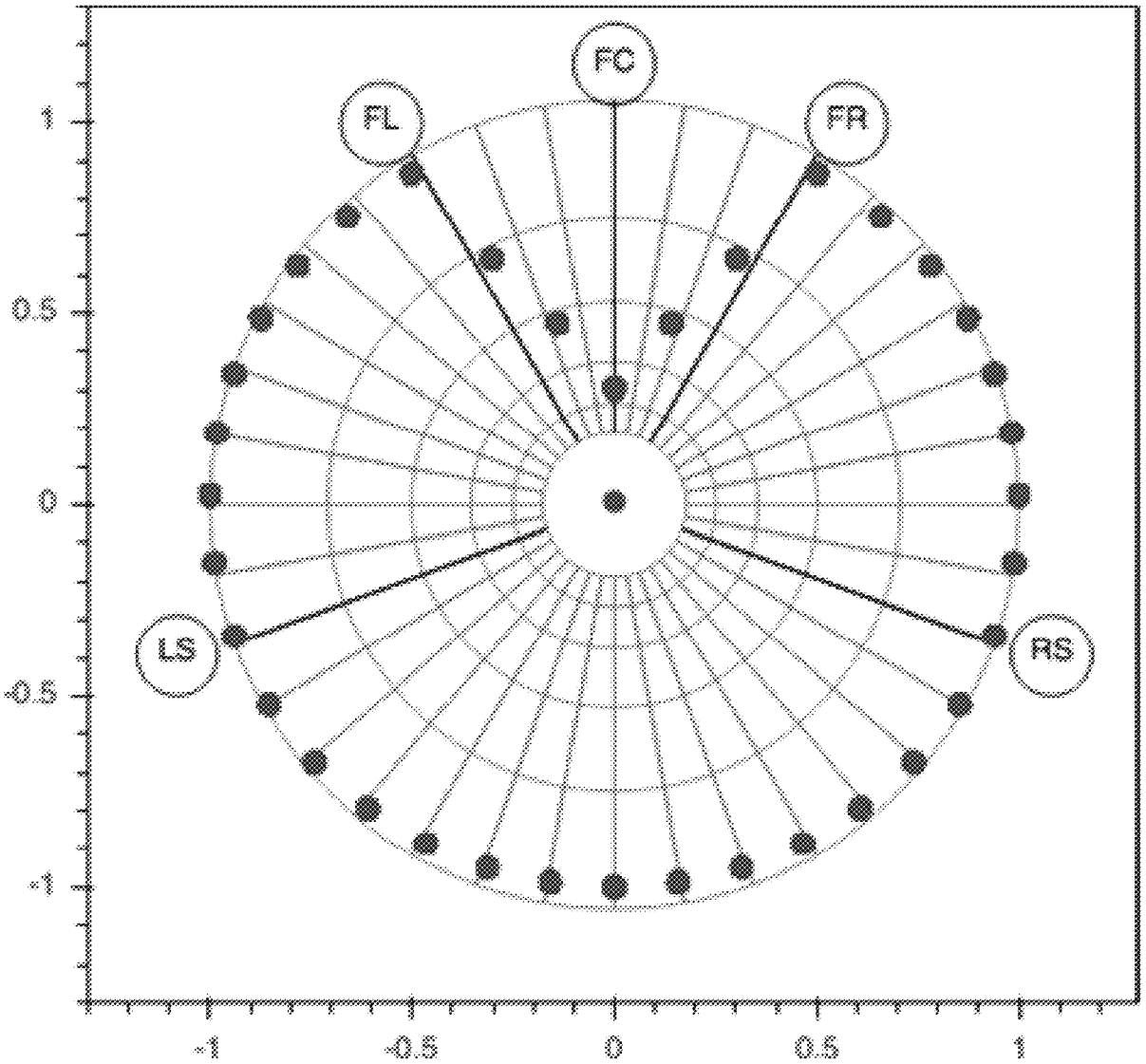
FIG. 10 shows an example a mono signal, panned in increments of ten degrees around the soundstage, without phantom panning correction that can account for audio not being pannable in the front center channel, in accordance with some embodiments.

FIG. 10 shows an example a mono signal, panned in increments of ten degrees around the soundstage, without phantom panning correction that can account for audio not being pannable in the front center channel, in accordance with some embodiments. The magnitude of the estimated position vectors is too low for azimuthal angles between the front left and front right channels.

Figure 11:
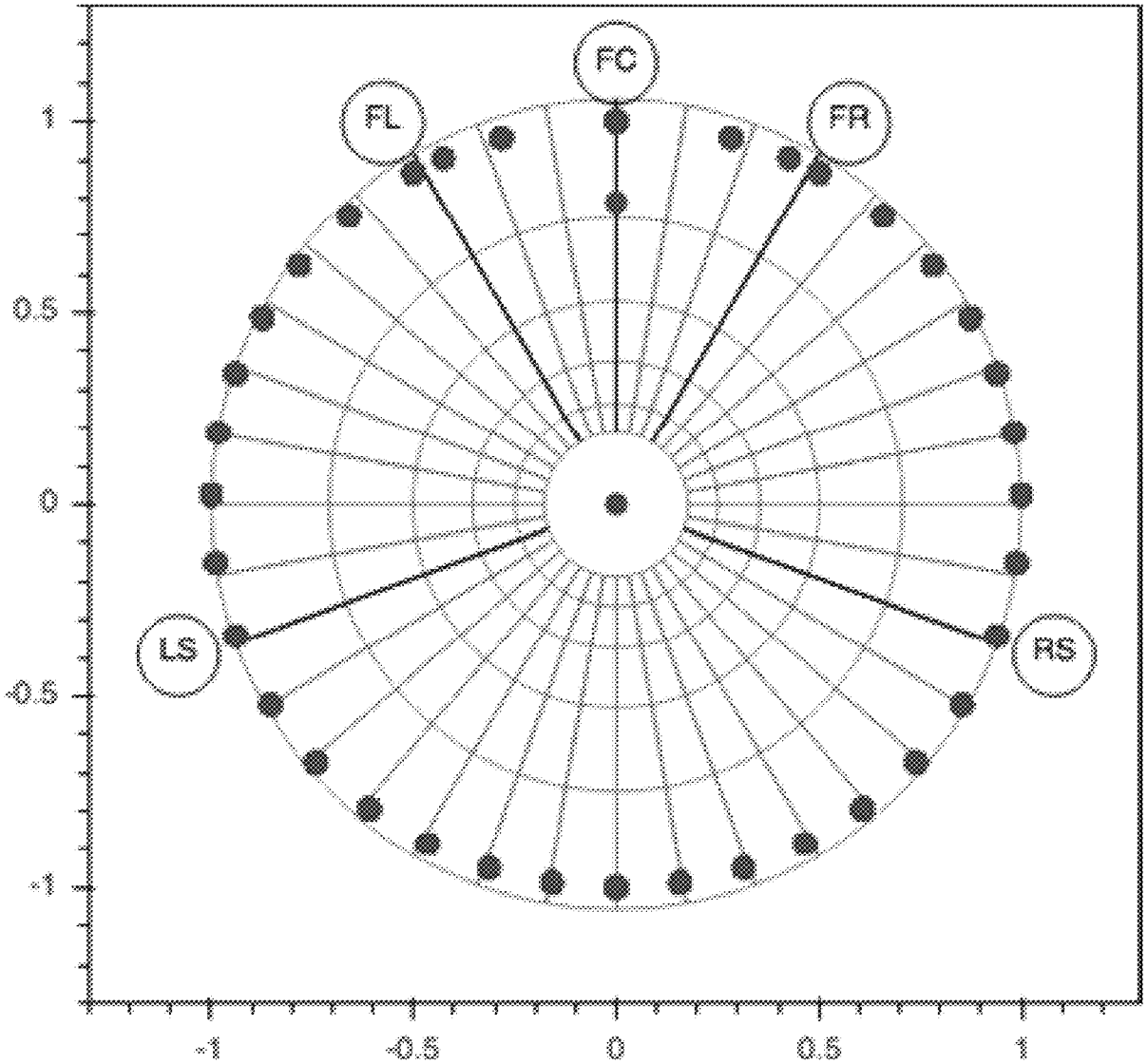
FIG. 11 shows an example of a mono signal, panned in increments often degrees around the soundstage, using phantom panning correction that can account for audio not being pannable in the front center channel, in accordance with some embodiments.

FIG. 11 shows an example of a mono signal, panned in increments often degrees around the soundstage, using phantom panning correction that can account for audio not being pannable in the front center channel, in accordance with some embodiments. The magnitude of the estimated position vectors is correct for azimuthal angles between the front left and front right channels.

In practice, the issue caused by the front center channel can be mitigated by crossfading between the estimated position vector calculated from the full set of channel location vectors, and that of another set without the phantom channel location or energy. The crossfading is controlled by:

$$\alpha = \sqrt{\frac{\hat{e}_p^2}{\hat{e}_p^2 + \hat{e}_j \hat{e}_i}}$$

where quantity $\alpha$ is a crossfade coefficient having a low value when the phantom channel envelope, $\hat{e}_p$, is lower than the adjacent channels envelopes, $\hat{e}_j$ and $\hat{e}_i$. This is but one specific example of a crossfade coefficient; other examples can also be used.

After the crossfade coefficient $\alpha$ has been calculated, the localization vector (or estimated position vector), $\vec{d}$, is can be calculated as follows:

$$\vec{d'} = \begin{cases} \vec{d} \text{ if } \theta_d \le \theta_j \\ \vec{d} \text{ if } \theta_d \ge \theta_i \\ \vec{d}\alpha + \vec{d_p}(1-\alpha) \text{ otherwise} \end{cases}$$

where the localization vector, $\vec{d}$, is crossfaded with a separate localization vector calculated without the phantom channel envelope, when the angle of the localization vector, $\theta_d$, is between the left center and right channel locations, $\theta_j$ and $\theta_i$. This is but one example; other suitable examples can also be used.

Thus far, there has been discussion of determining where in a soundstage a sound is positioned. There is also benefit in determining that the sound meets one or more specified criteria to be deemed significant. A sound that is deemed to be significant can be referred to as an event in the discussion that follows. In practice, event detection, as discussed below, can often be paired with localization, as discussed above.

Figure 12:
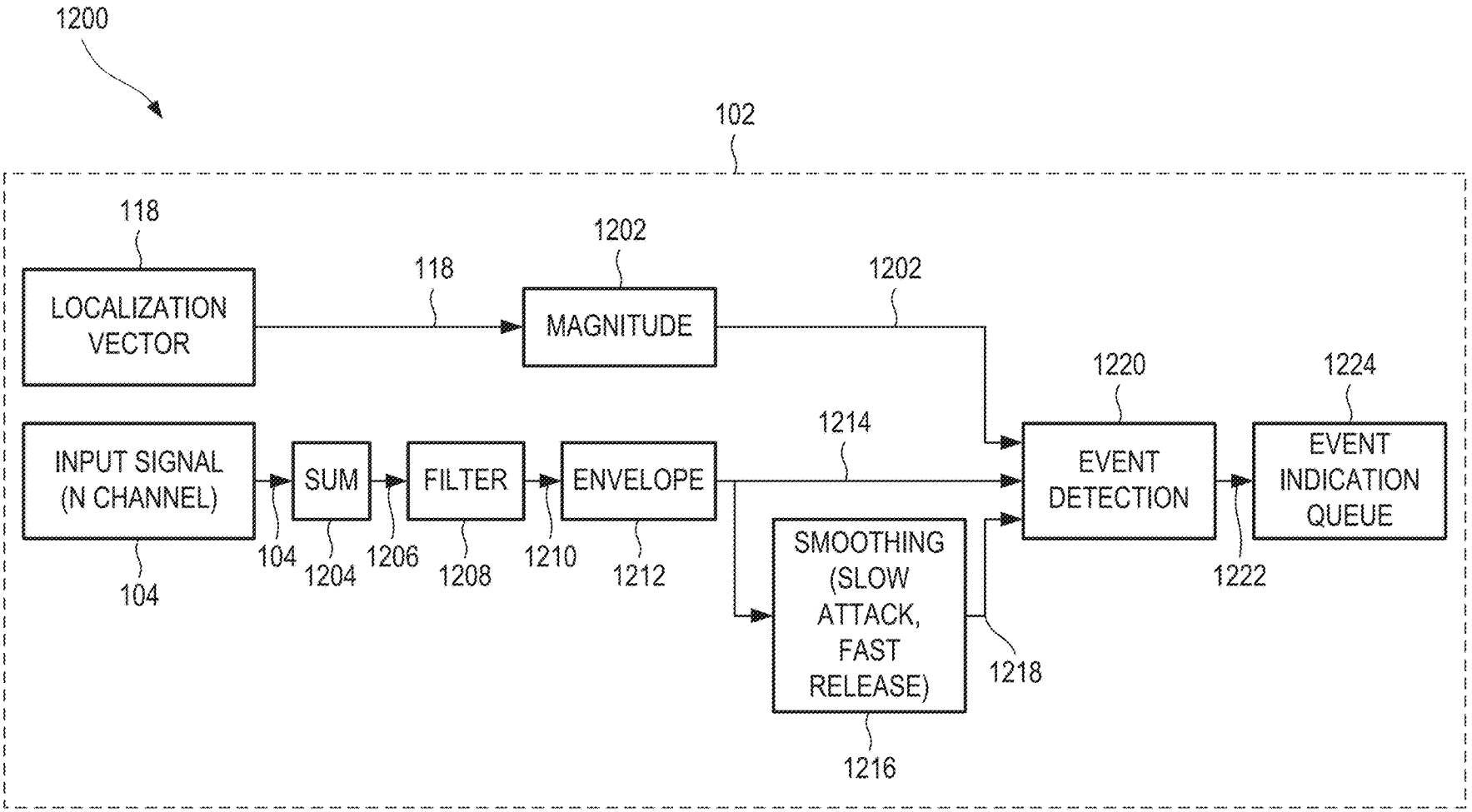
FIG. 12 shows an example of a system for processing multi-channel audio, in accordance with some embodiments.

FIG. 12 shows an example of a system 1200 for processing multi-channel audio, in accordance with some embodiments. The system 1200 can detect events present in the audio of a multi-channel audio signal. The configuration of FIG. 12 is but one example of a system that can determine a time-varying position of a sound in a multi-channel audio signal. Other suitable systems can also be used.

The processor 102 (see FIG. 1) can examine a magnitude 1202 of a localization vector (or estimated position vector, or time-varying position) 118. In some examples, the processor 102 can determine that a magnitude of the time-varying position has exceeded a specified magnitude threshold for at least a specified duration. In some examples, the processor 102 can compared the magnitude 1202 to a specified magnitude threshold. If the magnitude 1202 is less than the specified magnitude threshold, corresponding to cases in which the sound is relatively close to the listener and is not strongly panned to an edge of the soundstage, then the processor 102 can ignore the sound (e.g., can deem the sound as insignificant, can neglect to report the sound in an event queue, and so forth). If the magnitude 1202 is greater than the specified magnitude threshold, corresponding to cases in which the sound is panned peripherally, then the processor 102 can deem the sound as significant, can report the sound in an event queue, and so forth.

Variations of event detection can be extended to include other signal analysis, and statistics to predict the likelihood of event classes that should be ignored or that are assistive to the user's application, such as footsteps, airplanes, approaching vehicles, and the like. Event classes can be communicated as binary, or soft indications. The event detection can use techniques such as machine learning, statistical learning, predictive learning, or artificial intelligence. Techniques can use one or more procedures such as classification and regression trees, support vector machines, artificial neural networks, logistic regression, naïve Bayes classification, linear discriminant analysis, and random forests.

At operation 1204, the processor 102 can sum the multi-channel audio signal 104 (see FIG. 1) to produce a mono audio signal 1206. In some examples, the summing is performed such that the channels are weighted evenly. In other examples, the summing is performed as a weighted sum, with one or more different weightings for the channels.

At operation 1208, the processor 102 can apply a high-pass filter to the mono audio signal 1206 to produce a filtered mono signal 1210. Although the signal is high-pass filtered, low frequency onsets can be detected because high frequency energy is introduced during onsets with reasonably fast attack envelopes. The mono sum also has an advantage that intensity panned sounds can combine constructively, and decorrelated noise may not combine constructively.

At operation 1212, the processor 102 can apply an envelope to the filtered mono signal 1210 to determine a time-varying volume level 1214 for the filtered mono signal 1210. The envelope can include any of the envelopes discussed above with regard to FIG. 1.

At operation 1216, the processor 102 can smooth the time-varying volume level 1214 to produce a smoothed time-varying volume level 1218. In some examples, the smoothing can use a filter having relatively slow attack ballistics and relatively fast release ballistics. Operation 1216 can produce a smoothed volume level 1218, which is biased toward minima in the time-varying volume level 1214 that closely track a noise level of the audio signals.

In some examples, the processor 102 can perform the smoothing using an exponential moving average as follows:

$$\hat{e}'_t[n]\begin{cases}(1-\alpha)\hat{e}'_t[n-1]+\alpha\hat{e}_t[n] & \text{if } \hat{e}_t[n]>\hat{e}'_t[n]\\(1-\beta)\hat{e}'_t[n-1]+\beta\hat{e}_t[n] & \text{otherwise}\end{cases}$$

where quantity $\alpha$ is an attack ballistic, and quantity $\beta$ is a release ballistic employed for each sliding-window time index, n. Other smoothing techniques can also be used.

Note that onsets or transients within the signal are detected using crest factor analysis where the short-term signal envelope is compared with the smoothed envelope. When the short-term envelope exceeds the smoothed envelope by a threshold, a potential event is detected until the short-term envelope falls below another threshold that is typically set between the smoothed envelope and the on threshold. The two thresholds create a behavior of hysteresis at event detection 1220.

When a potential event is determined from the signal envelope, other criteria can be considered before detecting an event. In order for event detection to be robust to false positives from noise, the persistence of a potential event can exceed a defined duration threshold. The localization magnitude can also exceed a defined magnitude threshold.

At operation 1220, the processor 102 can determining that a volume of the filtered mono signal exceeds the smoothed volume level during the specified duration. Upon making the determination, the processor can generate an event detection data signal 1222 representing the time during which the event is detected.

The processor can log one or more events from 1222 in an event indication queue 1224. The event indication queue 1224 can be a container that maintains and sorts the events within so that the most important events to the user are appropriately indicated. The removal of events that become less prioritized or expire is also handled by the queue. The event indication queue 1224 can follow a location of a sound source by updating the event location when the calculated localization angle, magnitude, and/or energy changes within specified parameter ranges. In some examples, the event indication queue 1224 can include one or more of: an event localization vector including data corresponding to angle and magnitude, a tracked localization vector including data corresponding to angle and magnitude, loudness, priority, class, time stamp, and/or duration/

The processor can direct the event detection data signal 1222, and/or the event indication queue 1224 to one or more downstream systems.

Thus far, there has been discussion of multi-channel audio that has more than two channels. As a special case of multi-channel audio, it is possible to localize audio from a two-channel stereo input signal, and do so in a way that is more useful than merely panning back and forth along a single line in the soundstage. In some examples, covariance between the left and right channels can determine localization toward the front or the rear of the soundstage.

Figure 13:
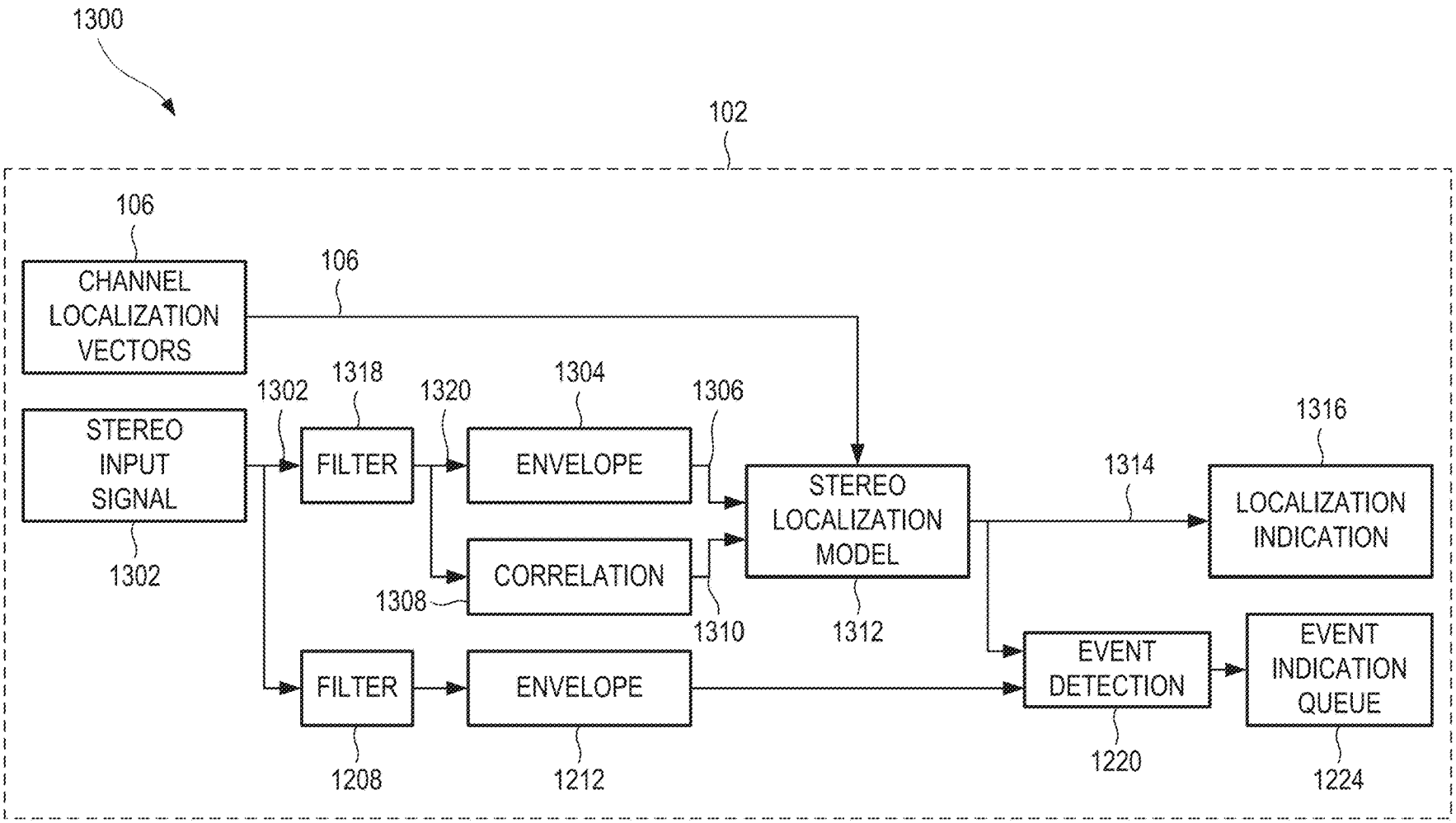
FIG. 13 shows an example of a system for processing multi-channel audio, in accordance with some embodiments.

FIG. 13 shows an example of a system 1300 for processing multi-channel audio, in accordance with some embodiments. The system 1300 can determine a time-varying position of a sound in a stereo (e.g., two-channel) audio signal. The configuration of FIG. 13 is but one example of a system that can determine a time-varying position of a sound in a stereo audio signal. Other suitable systems can also be used.

In some examples, the multi-channel audio signal can be a stereo audio signal 1302. In some examples, the stereo multi-channel audio signal 1302 can include a left channel and a right channel each azimuthally angled thirty degrees from a front of the listener position. Other angular positions can also be used.

In some examples, the processor 102 can determine the time-varying position in the soundstage of the sound by performing the following operations.

The processor 102 can determine (at operation 1304), based on the time-varying volume levels 1306 of the left and right channels (determined), a time-varying lateral component of the time-varying position, such that the time-varying lateral component is centered on the soundstage when the left and right channels have equal volumes, and the time-varying lateral component extends toward a louder of the left or right channels when the left and right channels have unequal volumes.

The processor 102 can (at operation 1308) determine a time-varying correlation 1310 between audio in the left channel and audio in the right channel.

The processor 102 can (at operation 1312), based on the time-varying correlation 1310, a front-back component of the time-varying position, such that the front-back component extends to a front of the listener position when the correlation is positive, and the front-back component extends to a back of the listener position when the correlation is negative.

The processor 102 can apply a stereo localization model 1312 to determine a time-varying position 1314 in the soundstage. The stereo localization model 1312 can use time-varying volume levels 1306, the time-varying correlation 1310, and the time-invariant channel localization vectors 106 as input. The processor 102 can, at a localization indication 1316, generate a location data signal representing the time-varying position of the sound.

The processor 102 can, optionally, apply a high-pass filter 1318 to each channel of the stereo audio signal 1302, to form a filtered stereo audio signal 1320. As explained above, the high-pass filters 1318 can de-emphasize non-directional low frequencies of the sound in determining the time-varying position of the sound.

The event indication for a stereo input signal is similar to the event indication shown in FIG. 12, with elements 1208, 1212, 1220, and 1224 of FIG. 12 being present in FIG. 13.

Figure 14:
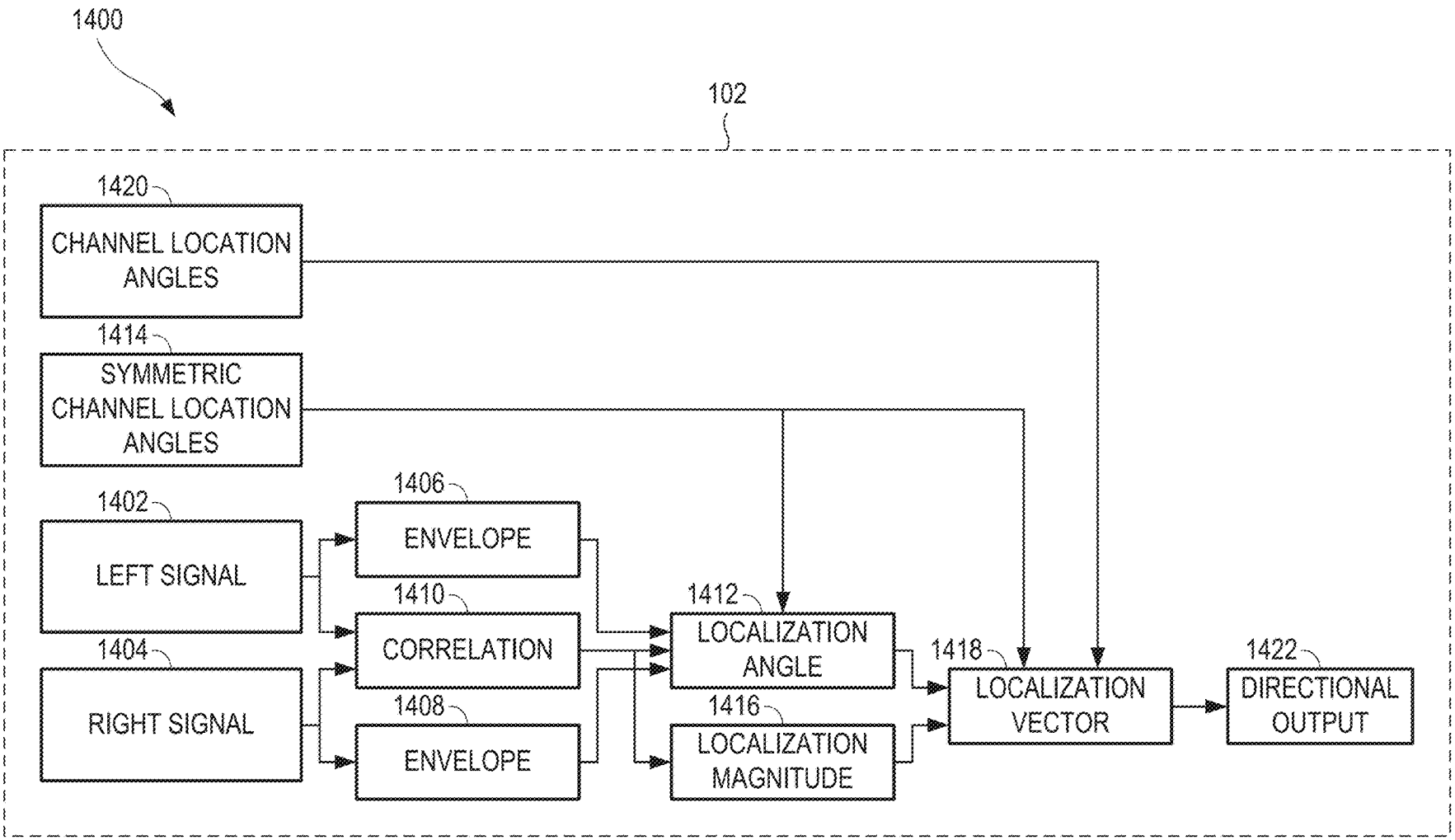
FIG. 14 shows an example of a system for processing multi-channel audio, in accordance with some embodiments.

Because stereo signals only provide two channels for analysis, the stereo localization model 1312 can rely on some assumptions about the signal characteristics for localizing the signal. Similar assumptions are commonly made when up-mixing stereo to multi-channel, and down-mixing multi-channel signals to stereo. First, the inter-channel level differences can determine the lateral panning location. For example, if the left channel is louder than the right channel, then the position vector can be positioned left-of-center in the soundstage. Second, correlation between left and right channels can determine the front/back localization. For example, when the left and right channels are at least partially in phase, the stereo signal can have a positive correlation, and the sound can be positioned between the left and right channel locations. When the left and right channels are at least partially out of phase, the stereo signal can have a negative correlation, and the sound can be positioned outside the left and right channel location. When the left and right channels show no correlation, the sound may not be localized, and the processor can calculate a relatively low localization magnitude. FIG. 14 shows an example of some aspects of these assumptions.

FIG. 14 shows an example of a system 1400 for processing multi-channel audio, in accordance with some embodiments. The system 1400 can determine a time-varying position of a sound in a stereo (e.g., two-channel) audio signal. The configuration of FIG. 14 is but one example of a system that can determine a time-varying position of a sound in a stereo audio signal. Other suitable systems can also be used.

The processor 102 can receive as input a time-varying left input signal 1402 and a time-varying right input signal 1404, both of which can be included in a multi-channel audio signal.

At operation 1406, the processor 102 can apply an envelope to determine a time-varying volume of the left input signal 1402.

At operation 1408, the processor 102 can apply an envelope to determine a time-varying volume of the right input signal 1404.

At operation 1410, the processor 102 can correlate the left input signal 1402 to the right input signal 1404 to form a time-varying correlation. The time-varying correlation can vary from to −1 (corresponding to where the left and right channels vary 180 degrees out of phase over time) to +1 (corresponding to a mono input signal, where the left and right channels vary in phase over time). A correlation value of zero means that the left and right channels vary independently over time. For positive correlation values, the position is selected to be in front of the listener (e.g., with azimuthal angles between −90 degrees and +90 degrees). For negative correlation values, the position is selected to be behind the listener (e.g., with azimuthal angles between −90 and −180 degrees, or between +90 and +180 degrees).

At operation 1412, the processor 102 can determine a localization angle (e.g., an azimuthal angle) of the time-varying position, using as input the time-varying volumes of the left and right input signals, the time-varying correlation between the left and right input signals, and a set of symmetric channel location angles 1414. In some examples, the symmetric channel location angles 1414 can be +90 degrees and −90 degrees, with respect to a front-facing orientation for the listener. Other angular positions can also be used.

At operation 1416, the processor 102 can determine a localization magnitude of the time-varying position, using as input the time-varying correlation between the left and right input signals.

At operation 1418, the processor 102 can form a localization vector representing the time-varying position, using as input the localization angle, the localization magnitude, and a set of channel location angles 1420. In some examples, the channel location angles 1420 can be +30 degrees and −30 degrees, with respect to a front-facing orientation for the listener. Other angular positions can also be used. The mapping between +/−90 degrees to +/−30 degrees is similar to the azimuthal angle adjustment shown in FIGS. 7 (before) and 8 (after).

At operation 1422, the processor 102 can generate a location data signal representing the time-varying position of the sound in the stereo audio input signal.

The aforementioned assumptions relating to stereo localization include that when the left, and right channels are out of phase or negatively correlated, the location vector should be located outside the left, and right channel locations, and/or behind the user. It then follows that the envelope estimation for event detection can be robust to stereo signals that are out of phase. In the multi-channel case, all signals are combined to mono as an optimization. For stereo, the implementation does not require that all channels are summed prior to estimating the envelope. Instead, envelopes for each channel can be estimated and combined using techniques, such as:

$$\hat{e}[n] = \sqrt{\sum_{m=0}^{M-1} \frac{1}{k} \sum_{k=0}^{K-1} x[m, n-k]^2}$$

where the estimated total envelope ê, at time index n, is calculated from a sum of mean energy within each channel x[m], spanning K samples.

In some examples, it can be beneficial to apply short-term smoothing to the time-varying position. To accomplish short-term smoothing, short-term localization vectors can be averaged is such a way that the more relevant vectors are weighted more heavily. When analyzing multiple short-term localization vectors over a medium-term, the vectors calculated from high relative envelope levels, and spatial magnitudes can be more relevant because the energy of noise tends to be evenly distributed across channels, and trend towards having a lower spatial magnitude. It then follows that when averaging short-term localization vectors, the average can represent more peripherally panned, and louder, localization vectors within the mean window.

In some examples, an energy level for a localization vector can be calculated as:

$$\hat{e}_t = \frac{1}{M} \sum_{m=0}^{M-1} \hat{e}[m]^2$$

where the total energy is $\hat{e}_t$, and ê[m] is the energy within each of the M channels.

A mean localization angle can then be determined as:

$$\angle\vec{d'}_{mean} = \frac{\sum_{k=0}^{K-1} \left\{\sin\angle\vec{d'}[k], \cos\angle\vec{d'}[k]\right\} \hat{e}_t[k] \left|\vec{d'}[k]\right|^2}{\sum_{k=0}^{K-1} \hat{e}_t[k] \left|\vec{d'}[k]\right|^2}$$

where K is a number of short-term localization vectors included in the average, weighted by energy, $\hat{e}_t[k]$, and spatial magnitude, $|\vec{d}[k]|$.

Finally, a mean localization magnitude can be determined as:

$$|\vec{d'}_{mean}| = \frac{\sum_{k=0}^{K-1} \left|\vec{d'}[k]\right| \hat{e}_t[k] \left|\vec{d'}[k]\right|^2}{\sum_{k=0}^{K-1} \hat{e}_t[k] \left|\vec{d'}[k]\right|^2}$$

This method for smoothing short-term localization vectors is generally suitable when user indication of more than one short-term localization vectors is needed. Other equivalent or approximate forms of averaging can also be used.

The techniques discussed thus far can be considered to be broadband, where all the operations discussed (except the high-pass filters) apply to the full range of audio frequencies. As an alternative, the audio signals can be selectively filtered to produce multiple frequency bands, such as a high-frequency band and a low-frequency band. The processor can apply similar analysis to what is discussed above to each frequency band individually. This can be referred to as time-frequency representation.

Advantages to time-frequency representation can include increased robustness with respect to ambient noise, and the ability to simultaneously track multiple sounds (in different frequency ranges). In some examples, the analysis discussed above can generate a time-varying position for each sound, or each frequency range.

In some examples, the received time domain signal can be transformed using time-frequency analysis, and localization vectors, and event data is calculated for each frequency band, and grouped based on similarity. The architecture using time-frequency representation where the received time domain signal can be transformed using time-frequency analysis, and localization vectors, and event data is calculated for each frequency band, and grouped based on similarity.

In some examples, a short-time Fourier transform (STFT) can be used for implementations of time-frequency representation. The STFT approach can perform a windowing function, and Fourier Transform of a received time domain signal for each overlapping period of time. The time-frequency envelope needed by the localization model, and event detection can be calculated as the magnitude of each complex frequency band over time. The number of time-frequency envelopes can be further reduced by grouping the magnitudes using Bark Scale, Critical Bands, Equivalent Rectangular Bandwidth, or other methods.

In some examples, when time-frequency representation is implemented, localization of more than one sound source is possible if the sound sources do not overlap too closely in time and in frequency. Cluster analysis can transform the received data for each frequency band into a set of data for each sound source. Cluster analysis can form an output similar to the time-domain approach, but with two forms of grouping functions. The localization cluster analysis can group the received bands of localization vectors into one or more localization vectors that can be directly indicated to a user. The event cluster analysis can perform the grouping based on localization similarity, and event detection.

Figure 15:
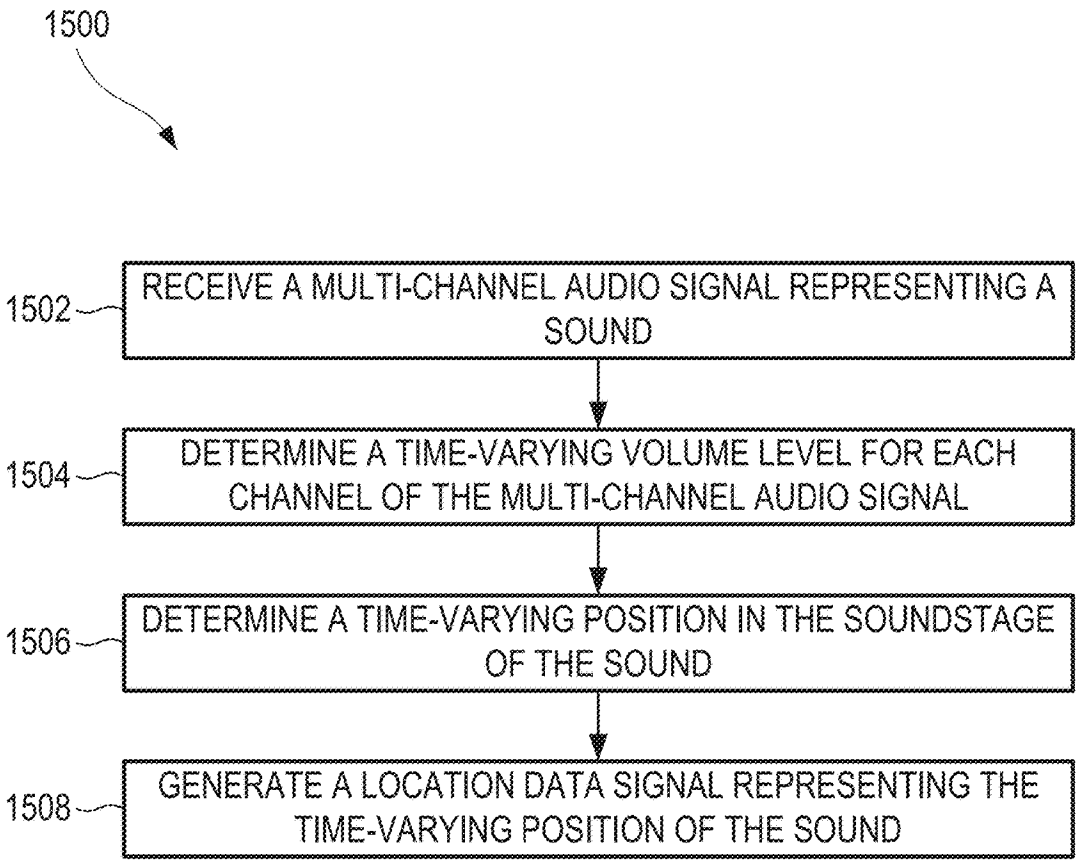
FIG. 15 shows an example of a method for processing multi-channel audio, in accordance with some embodiments.

FIG. 15 shows an example of a method 1500 for processing multi-channel audio, in accordance with some embodiments. The method 1500 can be executed on any of the systems or system elements shown in FIGS. 1-14, as well as other systems. The method 1500 is but one example of a method for processing multi-channel audio; other suitable methods can also be used.

At operation 1502, a processor can receive a multi-channel audio signal representing a sound. Each channel of the multi-channel audio signal can provide audio associated with a corresponding channel position around a perimeter of a soundstage.

At operation 1504, the processor can determine a time-varying volume level for each channel of the multi-channel audio signal.

At operation 1506, the processor can determine, from the time-varying volume levels and the channel positions, a time-varying position in the soundstage of the sound.

At operation 1508, the processor can generate a location data signal representing the time-varying position of the sound.

In some examples, the soundstage can be circular, the time-invariant channel positions can be time-invariant and can be located at respective azimuthal positions around a circumference of the soundstage, and a center of the soundstage can correspond to a listener position.

In some examples, the method can further include determining an estimated position vector, the estimated position vector falling within a polygonal shape in the soundstage.

In some examples, the method can further include scaling a magnitude of the estimated position vector, such that estimated position vectors falling on an edge of the polygon shape are scaled to fall on the circumference of the soundstage, and estimated position vectors falling in an interior of the polygon shape are scaled to increase a magnitude of the estimated position vector.

In some examples, the method can further include scaling an azimuthal angle of the estimated position vector to adjust front-to-back symmetry, such that position vectors of independent pink noise having equal volume in all the channels are scaled to fall at the center of the soundstage.

In some examples, the method can further include forming the time-varying position from the scaled estimated position vector.

To further illustrate the device and related method disclosed herein, a non-limiting list of examples is provided below. Each of the following non-limiting examples can stand on its own, or can be combined in any permutation or combination with any one or more of the other examples.

In Example 1, a system for processing multi-channel audio can include: at least one processor configured to: receive a multi-channel audio signal representing a sound, each channel of the multi-channel audio signal configured to provide audio associated with a corresponding channel position around a perimeter of a soundstage; determine a time-varying volume level for each channel of the multi-channel audio signal; determine, from the time-varying volume levels and the channel positions, a time-varying position in the soundstage of the sound; and generate a location data signal representing the time-varying position of the sound.

In Example 2, the system of Example 1 can optionally be configured such that the soundstage is circular, the channel positions are time-invariant and are located at respective azimuthal positions around a circumference of the soundstage, and a center of the soundstage corresponds to a listener position.

In Example 3, the system of any one of Examples 1-2 can optionally be configured such that the at least one processor is further configured to determine the time-varying position in the soundstage of the sound by: determining an estimated position vector, the estimated position vector falling within a polygonal shape in the soundstage.

In Example 4, the system of any one of Examples 1-3 can optionally be configured such that the multi-channel audio signal includes a front center channel that includes audio that is pannable; and the at least one processor is further configured to determine the polygonal shape by linearly connecting each time-invariant channel position with its adjacent time-invariant channel positions.

In Example 5, the system of any one of Examples 1-4 can optionally be configured such that the multi-channel audio signal includes a front center channel that is designated for audio that is not pannable; and the at least one processor is further configured to determine the polygonal shape by linearly connecting each time-invariant channel position with its adjacent time-invariant channel positions except for the front center channel, such that the time-invariant channel positions directly adjacent to the front center channel linearly connect with the center of the soundstage.

In Example 6, the system of any one of Examples 1-5 can optionally be configured such that the at least one processor is further configured to determine the time-varying position in the soundstage of the sound by further: scaling a magnitude of the estimated position vector, such that estimated position vectors falling on an edge of the polygon shape are scaled to fall on the circumference of the soundstage, and estimated position vectors falling in an interior of the polygon shape are scaled to increase a magnitude of the estimated position vector.

In Example 7, the system of any one of Examples 1-6 can optionally be configured such that the at least one processor is further configured to determine the time-varying position in the soundstage of the sound by further: scaling an azimuthal angle of the estimated position vector to adjust front-to-back symmetry, such that a test position vector corresponding to a case of independent pink noise having equal volume in all channels is scaled to fall substantially at the center of the soundstage.

In Example 8, the system of any one of Examples 1-7 can optionally be configured such that the at least one processor is further configured to scale the azimuthal angle vector by: determining provisional channel positions by equally spacing the time-invariant channel positions around the circumference of the soundstage; determining the estimated position vector using the provisional channel positions; and adjusting an azimuthal angle of the estimated position vector to maintain a proportional relative spacing of the estimated position vector between a pair of adjacent channel positions, as the channel positions are adjusted from the provisional channel positions to the time-invariant channel positions.

In Example 9, the system of any one of Examples 1-8 can optionally be configured such that the multi-channel audio signal includes 5.1 channels, the 5.1 channels including: a front center channel positioned azimuthally in front of the listener position, a front left channel and front right channel each azimuthally angled thirty degrees from the front center channel, and a left surround channel and a right surround channel each azimuthally angled one hundred ten degrees from the front center channel.

In Example 10, the system of any one of Examples 1-9 can optionally be configured such that the multi-channel audio signal includes 7.1 channels, the 7.1 channels including: a front center channel positioned azimuthally in front of the listener position, a front left channel and front right channel each azimuthally angled thirty degrees from the front center channel, a left side surround channel and a right side surround channel each azimuthally angled ninety degrees from the front center channel, and a left rear surround channel and a right rear surround channel each azimuthally angled one hundred fifty degrees from the front center channel.

In Example 11, the system of any one of Examples 1-10 can optionally be configured such that the multi-channel audio signal is stereo, the stereo multi-channel audio signal including a left channel and a right channel each azimuthally angled thirty degrees from a front of the listener position.

In Example 12, the system of any one of Examples 1-11 can optionally be configured such that the at least one processor is further configured to determine the time-varying position in the soundstage of the sound by: determining, based on the time-varying volume levels of the left and right channels, a time-varying lateral component of the time-varying position, such that the time-varying lateral component is centered on the soundstage when the left and right channels have equal volumes, and the time-varying lateral component extends toward a louder of the left or right channels when the left and right channels have unequal volumes; determining a time-varying correlation between audio in the left channel and audio in the right channel; determining, based on the time-varying correlation, a front-back component of the time-varying position, such that the front-back component extends to a front of the listener position when the correlation is positive, and the front-back component extends to a back of the listener position when the correlation is negative.

In Example 13, the system of any one of Examples 1-12 can optionally be configured such that the soundstage is spherical, the channel positions are time-invariant and are located at respective positions around the sphere, and a center of the sphere corresponds to a listener position.

In Example 14, the system of any one of Examples 1-13 can optionally be configured such that the at least one processor is further configured to, prior to determining the time-varying volume level for each channel, apply a high-pass filter to each channel, the high-pass filters configured to de-emphasize non-directional low frequencies of the sound in determining the time-varying position of the sound.

In Example 15, the system of any one of Examples 1-14 can optionally be configured such that the at least one processor is further configured to determine the time-varying position in the soundstage of the sound by further: determining a time-varying total energy for the channels in the multi-channel audio signal; averaging a magnitude of the time-varying position with a weighting that varies as a function of the time-varying total energy; and averaging an azimuthal angle of the time-varying position with a weighting that varies as a function of the time-varying total energy.

In Example 16, the system of any one of Examples 1-15 can optionally be configured such that the at least one processor is further configured to: spectrally filter the multi-channel audio signal into a first frequency band to form a first filtered multi-channel audio signal and a second frequency band to form a second filtered multi-channel audio signal; determine a first time-varying volume level for each channel of the first multi-channel audio signal; determine, from the first time-varying volume levels and the channel positions, a first time-varying position in the soundstage of the sound; determine a second time-varying volume level for each channel of the second multi-channel audio signal; determine, from the second time-varying volume levels and the channel positions, a second time-varying position in the soundstage of the sound; and generate the location data signal representing at least one of the first or second time-varying positions.

In Example 17, the system of any one of Examples 1-16 can optionally be configured such that the at least one processor is further configured to detect an event in the multi-channel audio signal, the event detection including: determining that a magnitude of the time-varying position has exceeded a specified magnitude threshold for at least a specified duration; summing the channels of the multi-channel audio signal and applying a high-pass filter to form a filtered mono signal; smoothing a volume of the filtered mono signal with a filter that has a slow attack and a fast release to form a smoothed volume level; during the specified duration, determining that a volume of the filtered mono signal exceeds the smoothed volume level; and generating an event detection data signal representing the time during which the event is detected.

In Example 18, a method for processing multi-channel audio can include: receiving a multi-channel audio signal representing a sound, each channel of the multi-channel audio signal configured to provide audio associated with a corresponding channel position around a perimeter of a soundstage; determining a time-varying volume level for each channel of the multi-channel audio signal; determining, from the time-varying volume levels and the channel positions, a time-varying position in the soundstage of the sound; and generating a location data signal representing the time-varying position of the sound.

In Example 19, the method of Example 18 can optionally be configured such that the soundstage is circular, the channel positions are time-invariant and are located at respective azimuthal positions around a circumference of the soundstage, and a center of the soundstage corresponds to a listener position; and further comprising: determining an estimated position vector, the estimated position vector falling within a polygonal shape in the soundstage; scaling a magnitude of the estimated position vector, such that estimated position vectors falling on an edge of the polygon shape are scaled to fall on the circumference of the soundstage, and estimated position vectors falling in an interior of the polygon shape are scaled to increase a magnitude of the estimated position vector; scaling an azimuthal angle of the estimated position vector to adjust front-to-back symmetry, such that position vectors of independent pink noise having equal volume in all the channels are scaled to fall at the center of the soundstage; and forming the time-varying position from the scaled estimated position vector.

In Example 20, a system for processing multi-channel audio can include: at least one processor configured to: receive a multi-channel audio signal representing a sound, each channel of the multi-channel audio signal configured to provide audio associated with a corresponding time-invariant channel position around a circumference of a circular soundstage, the time-invariant channel positions being located at respective azimuthal positions around the circumference of the soundstage, a center of the soundstage corresponding to a listener position; determine a time-varying volume level for each channel of the multi-channel audio signal; determine, from the time-varying volume levels and the time-invariant channel positions, an estimated position vector, the estimated position vector falling within a polygonal shape in the soundstage; radially scale the estimated position vector, such that estimated position vectors falling on an edge of the polygon shape are scaled to fall on the circumference of the soundstage, and estimated position vectors falling in an interior of the polygon shape are scaled to increase a magnitude of the estimated position vector; azimuthally scale the estimated position vector to adjust front-to-back symmetry such that position vectors of independent pink noise having equal volume in all the channels are scaled to fall at the center of the soundstage; form a time-varying position from the radially and azimuthally scaled estimated position vector; and generate a location data signal representing the time-varying position of the sound.

Many other variations than those described herein will be apparent from this document. For example, depending on the embodiment, certain acts, events, or functions of any of the methods and algorithms described herein can be performed in a different sequence, can be added, merged, or left out altogether (such that not all described acts or events are necessary for the practice of the methods and algorithms). Moreover, in certain embodiments, acts or events can be performed concurrently, such as through multi-threaded processing, interrupt processing, or multiple processors or processor cores or on other parallel architectures, rather than sequentially. In addition, different tasks or processes can be performed by different machines and computing systems that can function together.

The various illustrative logical blocks, modules, methods, and algorithm processes and sequences described in connection with the embodiments disclosed herein can be implemented as electronic hardware, computer software, or combinations of both. To clearly illustrate this interchangeability of hardware and software, various illustrative components, blocks, modules, and process actions have been described above generally in terms of their functionality. Whether such functionality is implemented as hardware or software depends upon the particular application and design constraints imposed on the overall system. The described functionality can be implemented in varying ways for each particular application, but such implementation decisions should not be interpreted as causing a departure from the scope of this document.

The various illustrative logical blocks and modules described in connection with the embodiments disclosed herein can be implemented or performed by circuitry that can include one or more processors, a machine, such as a general purpose processor, a processing device, a computing device having one or more processing devices, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor and processing device can be a microprocessor, but in the alternative, the processor can be a controller, microcontroller, or state machine, combinations of the same, or the like. A processor can also be implemented as a combination of computing devices, such as a combination of a DSP and a microprocessor, a plurality of microprocessors, one or more microprocessors in conjunction with a DSP core, or any other such configuration.

Embodiments of the system and method described herein are operational within numerous types of general purpose or special purpose computing system environments or configurations. In general, a computing environment can include any type of computer system, including, but not limited to, a computer system based on one or more microprocessors, a mainframe computer, a digital signal processor, a portable computing device, a personal organizer, a device controller, a computational engine within an appliance, a mobile phone, a desktop computer, a mobile computer, a tablet computer, a smartphone, and appliances with an embedded computer, to name a few.

Such computing devices can typically be found in devices having at least some minimum computational capability, including, but not limited to, personal computers, server computers, hand-held computing devices, laptop or mobile computers, communications devices such as cell phones and PDA's, multiprocessor systems, microprocessor-based systems, set top boxes, programmable consumer electronics, network PCs, minicomputers, mainframe computers, audio or video media players, and so forth. In some embodiments the computing devices will include one or more processors. Each processor may be a specialized microprocessor, such as a digital signal processor (DSP), a very long instruction word (VLIW), or other micro-controller, or can be conventional central processing units (CPUs) having one or more processing cores, including specialized graphics processing unit (GPU)-based cores in a multi-core CPU.

The process actions or operations of a method, process, or algorithm described in connection with the embodiments of the system and method disclosed herein can be embodied directly in hardware, in a software module executed by a processor, or in any combination of the two. The software module can be contained in computer-readable media that can be accessed by a computing device. The computer-readable media includes both volatile and nonvolatile media that is either removable, non-removable, or some combination thereof. The computer-readable media is used to store information such as computer-readable or computer-executable instructions, data structures, program modules, or other data. By way of example, and not limitation, computer readable media may comprise computer storage media and communication media.

Computer storage media includes, but is not limited to, computer or machine readable media or storage devices such as Bluray discs (BD), digital versatile discs (DVDs), compact discs (CDs), floppy disks, tape drives, hard drives, optical drives, solid state memory devices, RAM memory, ROM memory, EPROM memory, EEPROM memory, flash memory or other memory technology, magnetic cassettes, magnetic tapes, magnetic disk storage, or other magnetic storage devices, or any other device which can be used to store the desired information and which can be accessed by one or more computing devices.

A software module can reside in the RAM memory, flash memory, ROM memory, EPROM memory, EEPROM memory, registers, hard disk, a removable disk, a CD-ROM, or any other form of non-transitory computer-readable storage medium, media, or physical computer storage known in the art. In some examples, a storage medium can be coupled to the processor such that the processor can read information from, and write information to, the storage medium. In the alternative, the storage medium can be integral to the processor. The processor and the storage medium can reside in an application specific integrated circuit (ASIC). The ASIC can reside in a user terminal. Alternatively, the processor and the storage medium can reside as discrete components in a user terminal.

The phrase "non-transitory" as used in this document means "enduring or long-lived". The phrase "non-transitory computer-readable media" includes any and all computer-readable media, with the sole exception of a transitory, propagating signal. This includes, by way of example and not limitation, non-transitory computer-readable media such as register memory, processor cache and random-access memory (RAM).

The phrase "audio signal" is a signal that is representative of a physical sound.

Retention of information such as computer-readable or computer-executable instructions, data structures, program modules, and so forth, can also be accomplished by using a variety of the communication media to encode one or more modulated data signals, electromagnetic waves (such as carrier waves), or other transport mechanisms or communications protocols, and includes any wired or wireless information delivery mechanism. In general, these communication media refer to a signal that has one or more of its characteristics set or changed in such a manner as to encode information or instructions in the signal. For example, communication media includes wired media such as a wired network or direct-wired connection carrying one or more modulated data signals, and wireless media such as acoustic, radio frequency (RF), infrared, laser, and other wireless media for transmitting, receiving, or both, one or more modulated data signals or electromagnetic waves. Combinations of the any of the above should also be included within the scope of communication media.

Further, one or any combination of software, programs, computer program products that embody some or all of the various embodiments of the system and method described herein, or portions thereof, may be stored, received, transmitted, or read from any desired combination of computer or machine-readable media or storage devices and communication media in the form of computer executable instructions or other data structures.

Embodiments of the system and method described herein may be further described in the general context of computer-executable instructions, such as program modules, being executed by a computing device. Generally, program modules include routines, programs, objects, components, data structures, and so forth, which perform particular tasks or implement particular abstract data types. The embodiments described herein may also be practiced in distributed computing environments where tasks are performed by one or more remote processing devices, or within a cloud of one or more devices, that are linked through one or more communications networks. In a distributed computing environment, program modules may be located in both local and remote computer storage media including media storage devices. Still further, the aforementioned instructions may be implemented, in part or in whole, as hardware logic circuits, which may or may not include a processor.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

While the above detailed description has shown, described, and pointed out novel features as applied to various embodiments, it will be understood that various omissions, substitutions, and changes in the form and details of the devices or algorithms illustrated can be made without departing from the scope of the disclosure. As will be recognized, certain embodiments of the system and method described herein can be embodied within a form that does not provide all of the features and benefits set forth herein, as some features can be used or practiced separately from others.

What is claimed is:

1. A system for processing multi-channel audio, the system comprising:

at least one processor configured to:

receive a multi-channel audio signal representing a sound, each channel of the multi-channel audio signal configured to provide audio associated with a corresponding channel position around a perimeter of a soundstage;

determine a time-varying volume level for each channel of the multi-channel audio signal;

determine, from the time-varying volume levels and the channel positions, a time-varying estimated position vector that represents an estimated position in the soundstage of the sound;

scale a magnitude of the estimated position vector;

scale an azimuthal angle of the estimated position vector to adjust front-to-back symmetry, such that a test position vector corresponding to a case of independent pink noise having equal volume in all channels is scaled to fall substantially at the center of the soundstage; and generate, from the scaled magnitude and scaled azimuthal angle, a location data signal representing the time-varying position of the sound.

2. The system of claim 1, wherein the soundstage is circular, the channel positions are time-invariant and are located at respective azimuthal positions around a circumference of the soundstage, and a center of the soundstage corresponds to a listener position.

3. The system of claim 2, wherein the estimated position vector falls within a polygonal shape in the soundstage.

4. The system of claim 3, wherein the multi-channel audio signal includes a front center channel that includes audio that is pannable; and wherein the at least one processor is further configured to determine the polygonal shape by linearly connecting each time-invariant channel position with its adjacent time-invariant channel positions.

5. The system of claim 3, wherein the at least one processor is further configured to scale the magnitude of the estimated position vector such that estimated position vectors falling on an edge of the polygon shape are scaled to fall on the circumference of the soundstage, and estimated position vectors falling in an interior of the polygon shape are scaled to increase a magnitude of the estimated position vector.

6. The system of claim 2, wherein the at least one processor is further configured to scale the azimuthal angle vector by:

determining provisional channel positions by equally spacing the time-invariant channel positions around the circumference of the soundstage;

determining the estimated position vector using the provisional channel positions; and adjusting an azimuthal angle of the estimated position vector to maintain a proportional relative spacing of the estimated position vector between a pair of adjacent channel positions, as the channel positions are adjusted from the provisional channel positions to the time-invariant channel positions.

7. The system of claim 2, wherein the multi-channel audio signal includes 5.1 channels, the 5.1 channels including:

a front center channel positioned azimuthally in front of the listener position, a front left channel and front right channel each azimuthally angled thirty degrees from the front center channel, and a left surround channel and a right surround channel each azimuthally angled one hundred ten degrees from the front center channel.

8. The system of claim 2, wherein the multi-channel audio signal includes 7.1 channels, the 7.1 channels including:

a front center channel positioned azimuthally in front of the listener position, a front left channel and front right channel each azimuthally angled thirty degrees from the front center channel, a left side surround channel and a right side surround channel each azimuthally angled ninety degrees from the front center channel, and a left rear surround channel and a right rear surround channel each azimuthally angled one hundred fifty degrees from the front center channel.

9. The system of claim 2, wherein the multi-channel audio signal is stereo, the stereo multi-channel audio signal including a left channel and a right channel each azimuthally angled thirty degrees from a front of the listener position.

10. The system of claim 9, wherein the at least one processor is further configured to determine the time-varying position in the soundstage of the sound by:

determining, based on the time-varying volume levels of the left and right channels, a time-varying lateral component of the time-varying position, such that the time-varying lateral component is centered on the soundstage when the left and right channels have equal volumes, and the time-varying lateral component extends toward a louder of the left or right channels when the left and right channels have unequal volumes;

determining a time-varying correlation between audio in the left channel and audio in the right channel;

determining, based on the time-varying correlation, a front-back component of the time-varying position, such that the front-back component extends to a front of the listener position when the correlation is positive, and the front-back component extends to a back of the listener position when the correlation is negative.

11. The system of claim 1, wherein the soundstage is spherical, the channel positions are time-invariant and are located at respective positions around the sphere, and a center of the sphere corresponds to a listener position.

12. The system of claim 1, wherein the at least one processor is further configured to, prior to determining the time-varying volume level for each channel, apply a high-pass filter to each channel, the high-pass filters configured to de-emphasize non-directional low frequencies of the sound in determining the time-varying position of the sound.

13. The system of claim 1, wherein the at least one processor is further configured to determine the time-varying position in the soundstage of the sound by further:

determining a time-varying total energy for the channels in the multi-channel audio signal;

averaging a magnitude of the time-varying position with a weighting that varies as a function of the time-varying total energy; and averaging an azimuthal angle of the time-varying position with a weighting that varies as a function of the time-varying total energy.

14. The system of claim 1, wherein the at least one processor is further configured to:

spectrally filter the multi-channel audio signal into a first frequency band to form a first filtered multi-channel audio signal and a second frequency band to form a second filtered multi-channel audio signal;

determine a first time-varying volume level for each channel of the first multi-channel audio signal;

determine, from the first time-varying volume levels and the channel positions, a first time-varying position in the soundstage of the sound;

determine a second time-varying volume level for each channel of the second multi-channel audio signal;

determine, from the second time-varying volume levels and the channel positions, a second time-varying position in the soundstage of the sound; and generate the location data signal representing at least one of the first or second time-varying positions.

15. A system for processing multi-channel audio, the system comprising:

at least one processor configured to:

receive a multi-channel audio signal representing a sound, each channel of the multi-channel audio signal configured to provide audio associated with a corresponding channel position around a perimeter of a soundstage;

determine a time-varying volume level for each channel of the multi-channel audio signal;

determine, from the time-varying volume levels and the channel positions, a time-varying position in the soundstage of the sound by determining an estimated position vector, the estimated position vector failing within a polygonal shape in the soundstage; and generate a location data signal representing the time-varying position of the sound;

wherein the soundstage is circular, the channel positions are time-invariant and are located at respective azimuthal positions around a circumference of the soundstage;

wherein a center of the soundstage corresponds to a listener position;

wherein the multi-channel audio signal includes a front center channel that is designated for audio that is not pannable; and wherein the at least one processor is further configured to determine the polygonal shape by linearly connecting each time-invariant channel position with its adjacent time-invariant channel positions except for the front center channel, such that the time-invariant channel positions directly adjacent to the front center channel linearly connect with the center of the soundstage.

16. A system for processing multi-channel audio, the system comprising:

at least one processor configured to:

receive a multi-channel audio signal representing a sound, each channel of the multi-channel audio signal configured to provide audio associated with a corresponding channel position around a perimeter of a soundstage;

determine a time-varying volume level for each channel of the multi-channel audio signal;

determine, from the time-varying volume levels and the channel positions, a time-varying position in the soundstage of the sound;

generate a location data signal representing the time-varying position of the sound; and detect an event in the multi-channel audio signal, the event detection including:

determining that a magnitude of the time-varying position has exceeded a specified magnitude threshold for at least a specified duration;

summing the channels of the multi-channel audio signal and applying a high-pass filter to form a filtered mono signal;

smoothing a volume of the filtered mono signal with a filter that has a slow attack and a fast release to form a smoothed volume level;

during the specified duration, determining that a volume of the filtered mono signal exceeds the smoothed volume level; and generating an event detection data signal representing the time during which the event is detected.

17. A method for processing multi-channel audio, the method comprising:

receiving a multi-channel audio signal representing a sound, each channel of the multi-channel audio signal configured to provide audio associated with a corresponding channel position around a perimeter of a soundstage;

determining a time-varying volume level for each channel of the multi-channel audio signal;

determining, from the time-varying volume levels and the channel positions, a time-varying estimated position vector that represents an estimated position in the soundstage of the sound;

scaling a magnitude of the estimated position vector;

scaling an azimuthal angle of the estimated position vector to adjust front-to-back symmetry, such that a test position vector corresponding to a case of independent pink noise having equal volume in all channels is scaled to fall substantially at the center of the soundstage; and generating, from the scaled magnitude and scaled azimuthal angle, a location data signal representing the time-varying position of the sound.

18. The method of claim 17, wherein the soundstage is circular, the channel positions are time-invariant and are located at respective azimuthal positions around a circumference of the soundstage, and a center of the soundstage corresponds to a listener position;

wherein the estimated position vector falls within a polygonal shape in the soundstage; and wherein the magnitude of the estimated position vector is scaled such that estimated position vectors falling on an edge of the polygon shape are scaled to fall on the circumference of the soundstage, and estimated position vectors falling in an interior of the polygon shape are scaled to increase a magnitude of the estimated position vector.

19. A system for processing multi-channel audio, the system comprising:

at least one processor configured to:

receive a multi-channel audio signal representing a sound, each channel of the multi-channel audio signal configured to provide audio associated with a corresponding time-invariant channel position around a circumference of a circular soundstage, the time-invariant channel positions being located at respective azimuthal positions around the circumference of the soundstage, a center of the soundstage corresponding to a listener position;

determine a time-varying volume level for each channel of the multi-channel audio signal;

determine, from the time-varying volume levels and the time-invariant channel positions, an estimated position vector, the estimated position vector falling within a polygonal shape in the soundstage;

radially scale the estimated position vector, such that estimated position vectors falling on an edge of the polygon shape are scaled to fall on the circumference of the soundstage, and estimated position vectors falling in an interior of the polygon shape are scaled to increase a magnitude of the estimated position vector;

azimuthally scale the estimated position vector to adjust front-to-back symmetry such that position vectors of independent pink noise having equal volume in all the channels are scaled to fall at the center of the soundstage;

form a time-varying position from the radially and azimuthally scaled estimated position vector; and generate a location data signal representing the time-varying position of the sound.

* * * * *